US011179947B2

(12) United States Patent
Tsukada et al.

(10) Patent No.: US 11,179,947 B2
(45) Date of Patent: Nov. 23, 2021

(54) LIQUID EJECTING APPARATUS AND METHOD OF CONTROLLING LIQUID EJECTING APPARATUS

(71) Applicant: SEIKO EPSON CORPORATION, Tokyo (JP)

(72) Inventors: Kenji Tsukada, Shiojiri (JP); Yuki Hirabayashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/034,331

(22) Filed: Sep. 28, 2020

(65) Prior Publication Data

US 2021/0094312 A1 Apr. 1, 2021

(30) Foreign Application Priority Data

Sep. 30, 2019 (JP) ..... JP2019-178738
Sep. 30, 2019 (JP) ..... JP2019-178876

(51) Int. Cl.
*B41J 2/175* (2006.01)
*B41J 2/19* (2006.01)

(52) U.S. Cl.
CPC ..... *B41J 2/17596* (2013.01); *B41J 2/19* (2013.01)

(58) Field of Classification Search
CPC .... B41J 2/17596; B41J 2/175; B41J 2/17566; B41J 2/18; B41J 2/19; B41J 2/16505
USPC ..... 347/84, 85, 89, 92
See application file for complete search history.

(56) References Cited

U.S. PATENT DOCUMENTS 8,985,736 B2 * 3/2015 Akaba ..... B41J 2/16526 347/22
9,827,771 B2 * 11/2017 Murayama ..... B41J 2/175
10,538,096 B2 * 1/2020 Abe ..... B41J 2/175
10,759,181 B2 * 9/2020 Tokisawa ..... B41J 2/175
2019/0009562 A1 1/2019 Abe et al.
2019/0009563 A1 1/2019 Tokisawa et al.

FOREIGN PATENT DOCUMENTS

JP 2019-014162 1/2019
JP 2019-014253 1/2019

* cited by examiner

*Primary Examiner* — An H Do
(74) *Attorney, Agent, or Firm* — Workman Nydegger

(57) ABSTRACT

A liquid ejecting apparatus includes a liquid ejection head that ejects a liquid, a liquid supply flow path including a liquid storage unit that stores the liquid, a supply pump sending the liquid from the liquid storage unit to the liquid ejection head, a coupling flow path coupling a first supply coupling portion and a second supply coupling portion in the liquid supply flow path, a branch flow path coupling a third supply coupling portion provided in the coupling flow path and the liquid storage unit, an opening/closing valve provided in the branch flow path, where the opening/closing valve is configured to open/close the branch flow path, and a controller, wherein the controller fills the coupling flow path and the branch flow path with the liquid with a combination of a drive of the supply pump and an opening/closing operation of the opening/closing valve.

9 Claims, 22 Drawing Sheets

LIQUID EJECTING APPARATUS AND METHOD OF CONTROLLING LIQUID EJECTING APPARATUS

The present application is based on, and claims priority from JP Application Serial Number 2019-178738, filed Sep. 30, 2019 and JP Application Serial Number 2019-178876, filed Sep. 30, 2019, the disclosures of which are hereby incorporated by reference herein in their entirety.

BACKGROUND

1. Technical Field

The present disclosure relates to a liquid ejecting apparatus such as a printer and a method of controlling the liquid ejecting apparatus.

2. Related Art

For example, as in JP-A-2019-14253, there is a recording apparatus, which is an example of a liquid ejecting apparatus that ejects ink, which is an example of a liquid, from a recording head, which is an example of a liquid ejection head, to perform printing. The recording apparatus includes a supply flow path, which is an example of a liquid supply flow path that supplies ink to the recording head from a sub-tank, which is an example of a liquid storage unit, a supply pump provided in the supply flow path, and a relief flow path, which is an example of a coupling flow path that couples the upstream and the downstream of the supply pump. The relief flow path is a flow path that branches off from the supply flow path. Therefore, it is not possible to fill the relief flow path with ink simply by driving the supply pump, and air bubbles remain in the relief flow path.

Therefore, the recording apparatus fill the relief flow path with ink with a head replacement flow path coupling the supply flow path and the sub-tank, and a head replacement valve provided in the head replacement flow path. Specifically, the recording apparatus drives the supply pump in a state where the head replacement valve is closed to circulate the air bubbles remaining in the relief flow path through the relief flow path and the supply flow path. The recording apparatus drives the supply pump in a state where the head replacement valve is opened to move the air bubbles in the supply flow path to the sub-tank via the head replacement flow path. The recording apparatus fills the relief flow path with ink by repeatedly opening/closing the head replacement valve.

The air bubbles are likely to remain in the coupling flow path that branches off from the liquid supply flow path when the coupling flow path is filled with the liquid. However, in the configuration of the recording apparatus described in JP-A-2019-14253, it is necessary to repeatedly open/close the head replacement valve, and it takes time to fill the coupling flow path with the liquid.

SUMMARY

According to an aspect of the present disclosure, a liquid ejecting apparatus includes a liquid ejection head that ejects a liquid, a liquid supply flow path including a liquid storage unit that stores the liquid to be supplied to the liquid ejection head, where the liquid supply flow path supplies the liquid from the liquid storage unit to the liquid ejection head, a supply pump disposed in the liquid supply flow path, where the supply pump sends the liquid from the liquid storage unit to the liquid ejection head, a coupling flow path coupling a first coupling portion, in the liquid supply flow path, provided downstream of the supply pump and a second coupling portion, in the liquid supply flow path, provided upstream of the supply pump, a branch flow path coupling a third coupling portion provided in the coupling flow path and the liquid storage unit, an opening/closing valve provided in the branch flow path, where the opening/closing valve is configured to open/close the branch flow path, and a controller that controls an operation of the supply pump and the opening/closing valve, wherein the controller fills the coupling flow path and the branch flow path with the liquid with a combination of a drive of the supply pump and an opening/closing operation of the opening/closing valve.

According to another aspect of the present disclosure, in a method of controlling a liquid ejecting apparatus, where the liquid ejecting apparatus includes a liquid ejection head that ejects a liquid, a liquid supply flow path including a liquid storage unit that stores the liquid to be supplied to the liquid ejection head, where the liquid supply flow path supplies the liquid from the liquid storage unit to the liquid ejection head, a supply pump disposed in the liquid supply flow path, where the supply pump sends the liquid from the liquid storage unit to the liquid ejection head, a coupling flow path coupling a first coupling portion, in the liquid supply flow path, provided downstream of the supply pump and a second coupling portion, in the liquid supply flow path, provided upstream of the supply pump, a branch flow path coupling a third coupling portion provided in the coupling flow path and the liquid storage unit, and an opening/closing valve provided in the branch flow path. The method includes driving the supply pump in a state where the opening/closing valve is open, closing the opening/closing valve after a first time elapses since the supply pump was driven, and opening the opening/closing valve after a second time elapses since the opening/closing valve was closed.

DESCRIPTION OF EXEMPLARY EMBODIMENTS

Figure 1:
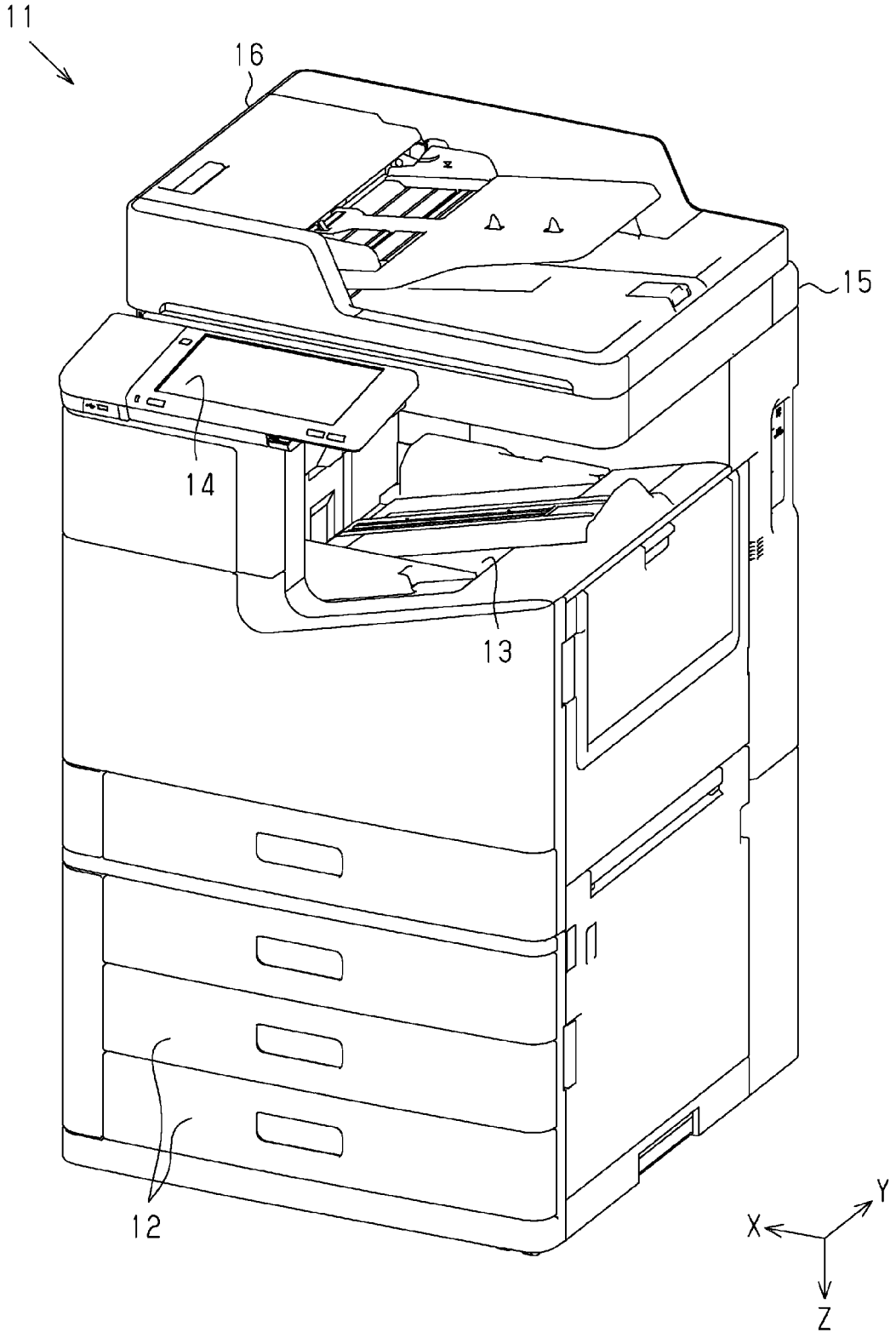
FIG. 1 is a perspective view of an embodiment of a liquid ejecting apparatus.

Hereinafter, an embodiment of a liquid ejecting apparatus and a method of controlling the liquid ejecting apparatus will be described with reference to the drawings. The liquid ejecting apparatus is, for example, an ink jet printer that ejects ink, which is an example of a liquid, onto a medium such as paper to perform printing.

In the drawings, the direction of gravity is indicated by the Z axis, and the directions along the horizontal plane are indicated by the X axis and the Y axis, assuming that a liquid ejecting apparatus 11 is mounted on the horizontal plane. The X axis, the Y axis, and the Z axis are orthogonal to each other.

As shown in FIG. 1, the liquid ejecting apparatus 11 may include a medium housing 12 capable of housing media, a stacker 13 that receives the printed medium, and an operation unit 14 such as a touch panel for operating the liquid ejecting apparatus 11. The liquid ejecting apparatus 11 may include an image reading unit 15 that reads an image of a document, and an automatic feeding unit 16 that sends the document to the image reading unit 15.

Figure 2:
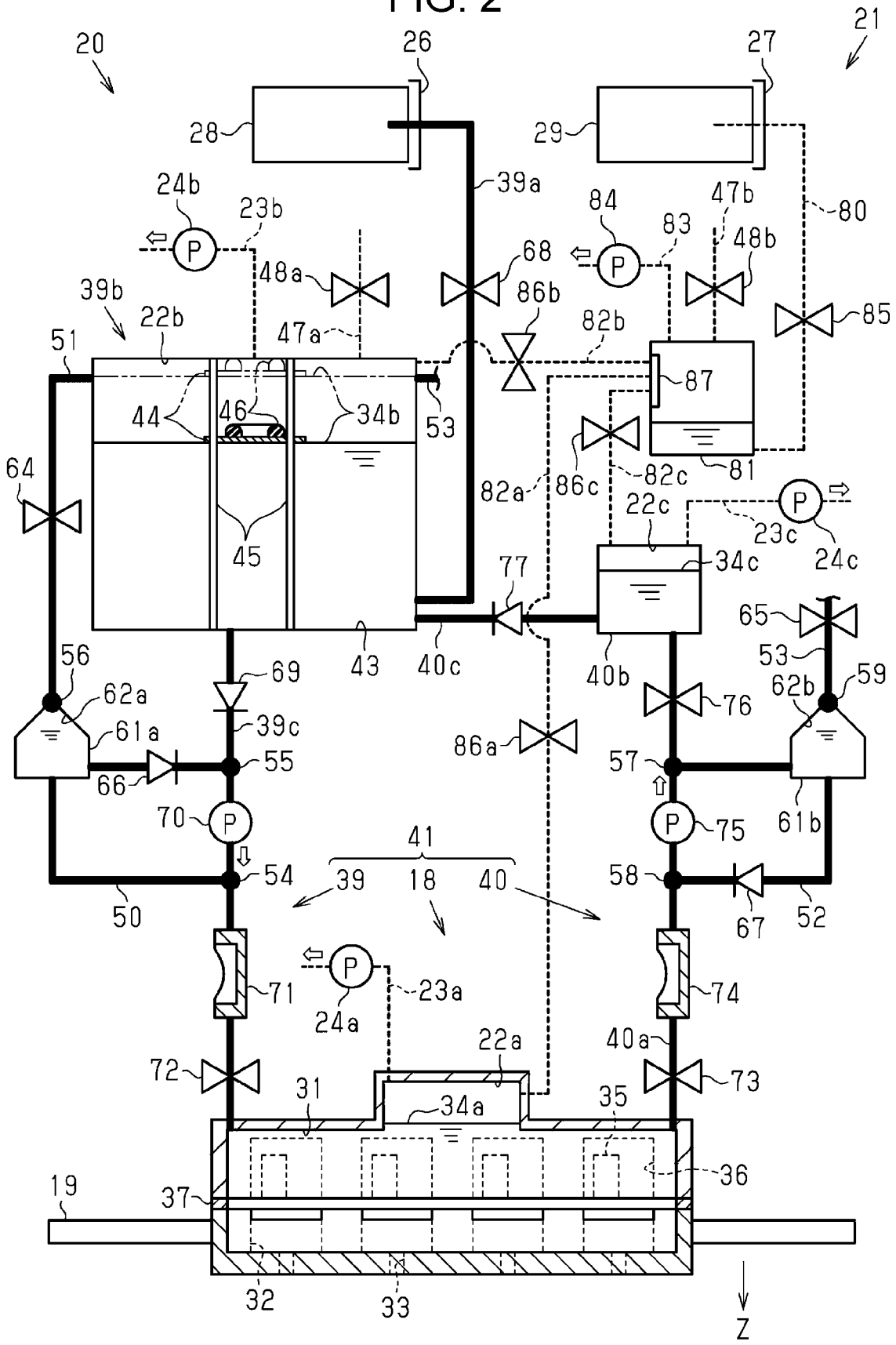
FIG. 2 is a schematic diagram of a liquid supply unit and a water vapor supply unit.

As shown in FIG. 2, the liquid ejecting apparatus 11 includes a liquid ejection head 18 that ejects the liquid to perform printing on a medium. The liquid ejecting apparatus 11 may include a loader 19 to which the liquid ejection head 18 is detachably loaded. The liquid ejecting apparatus 11 includes a liquid supply unit 20 that supplies the liquid to a liquid ejection head 18 and a water vapor supply unit 21 that supplies the water vapor to the liquid ejection head 18 and the liquid supply unit 20.

The liquid ejecting apparatus 11 may include one or a plurality of water vapor replenishment chambers to which the water vapor is supplied by the water vapor supply unit 21. The liquid ejecting apparatus 11 of the present embodiment includes a first water vapor replenishment chamber 22*a* provided in the liquid ejection head 18, and a second water vapor replenishment chamber 22*b* and a third water vapor replenishment chamber 22*c* provided in the liquid supply unit 20.

The liquid ejecting apparatus 11 may include a first vacuum flow path 23*a* communicating with the first water vapor replenishment chamber 22*a*, and a first vacuum pump 24*a* provided in the first vacuum flow path 23*a*. The liquid ejecting apparatus 11 includes a second vacuum flow path 23*b* communicating with the second water vapor replenishment chamber 22*b*, and a second vacuum pump 24*b*, which is an example of a vacuum pump provided in the second vacuum flow path 23*b*. The liquid ejecting apparatus 11 may include a third vacuum flow path 23*c* communicating with the third water vapor replenishment chamber 22*c*, and a third vacuum pump 24*c* provided in the third vacuum flow path 23*c*.

The liquid ejecting apparatus 11 may include a first mounting unit 26 and a second mounting unit 27, each of which is an example of a mounting unit. A liquid container 28 that stores a liquid to be supplied to the liquid ejection head 18 is mounted to the first mounting unit 26. A moisturizing liquid container 29 that stores a moisturizing liquid for generating a water vapor is mounted to the second mounting unit 27.

Next, the liquid ejection head 18 will be described. As shown in FIG. 2, the liquid ejection head 18 includes the first water vapor replenishment chamber 22*a*, a common liquid chamber 31 that stores the liquid supplied by the liquid supply unit 20, a plurality of pressure chambers 32 communicating with the common liquid chamber 31, and a nozzle 33 communicating with each pressure chamber 32. The first water vapor replenishment chamber 22*a* of the present embodiment is a space formed above a first liquid surface 34*a* of the liquid stored in the common liquid chamber 31, and communicates with the common liquid chamber 31. The liquid supplied from the liquid container 28 is supplied to the pressure chamber 32 via the common liquid chamber 31.

The liquid ejection head 18 includes an actuator 35 that vibrates the pressure chamber 32, a housing 36 that houses the actuator 35, and a diaphragm 37 that divides the pressure chamber 32 and the housing 36. The diaphragm 37 forms part of the wall face of the pressure chamber 32. The actuator 35 is, for example, a piezoelectric element that contracts when a drive voltage is applied. When the actuator 35 vibrates the pressure chamber 32, the liquid in the pressure chamber 32 is ejected as droplets from the nozzle 33.

Next, the liquid supply unit 20 will be described. As shown in FIG. 2, the liquid supply unit 20 includes a liquid supply flow path 39 for supplying the liquid stored in the liquid container 28 to the liquid ejection head 18, and a liquid collection flow path 40 for returning the liquid from the liquid ejection head 18 to the middle of the liquid supply flow path 39. The liquid supply flow path 39 and the liquid collection flow path 40 together with the liquid ejection head 18 form a circulation flow path 41.

The second water vapor replenishment chamber 22*b* is provided in the liquid supply flow path 39. The third water vapor replenishment chamber 22*c* is provided in the liquid collection flow path 40. Therefore, the second water vapor replenishment chamber 22*b* and the third water vapor replenishment chamber 22*c* together with the first water vapor replenishment chamber 22*a* provided in the liquid ejection head 18 are provided in the circulation flow path 41.

The liquid supply flow path 39 couples the liquid container 28 mounted on the first mounting unit 26, and the liquid ejection head 18. Specifically, the liquid supply flow path 39 has an upstream supply flow path 39*a* whose upstream end is coupled to the liquid container 28, a liquid storage unit 39*b* that stores the liquid supplied to the liquid ejection head 18, and a downstream supply flow path 39*c* whose downstream end is coupled to the liquid ejection head 18. The downstream end of the upstream supply flow path 39*a* and the upstream end of the downstream supply flow path 39*c* are coupled to the liquid storage unit 39*b*. When the upstream end of the downstream supply flow path 39*c* is coupled below the downstream end of the upstream supply flow path 39*a*, it is not likely for the liquid to stay in the liquid storage unit 39*b*. The liquid supply flow path 39 temporarily stores the liquid supplied from the liquid container 28 in the liquid storage unit 39*b*, and supplies the liquid from the liquid storage unit 39*b* to the liquid ejection head 18. The second water vapor replenishment chamber 22*b* is provided in the liquid storage unit 39*b*.

The liquid collection flow path 40 couples the liquid ejection head 18 and the liquid storage unit 39*b*. Specifically, the liquid collection flow path 40 has an upstream collection flow path 40*a* whose upstream end is coupled to the liquid ejection head 18, a collection storage unit 40*b* that stores the liquid that has passed through the liquid ejection head 18, and a downstream collection flow path 40*c* whose downstream end is coupled to the liquid storage unit 39*b*. The downstream end of the upstream collection flow path 40*a* and the upstream end of the downstream collection flow path 40*c* are coupled to the collection storage unit 40*b*. The third water vapor replenishment chamber 22*c* is provided in the collection storage unit 40*b*. The collection storage unit 40*b* stores the liquid that has passed through the liquid ejection head 18. The third water vapor replenishment chamber 22*c* of the present embodiment is a space formed above a third liquid surface 34*c* of the liquid stored in the collection storage unit 40*b*.

The liquid storage unit 39*b* includes the second water vapor replenishment chamber 22*b* and the storage chamber 43 that stores the liquid. The second water vapor replenishment chamber 22*b* of the present embodiment is a space formed above a second liquid surface 34*b* of the liquid stored in the storage chamber 43. The position of the second liquid surface 34*b* changes depending on the amount of liquid stored in the storage chamber 43. The second water vapor replenishment chamber 22*b* is a space above the second liquid surface 34*b* indicated by the chain double-dashed line in FIG. 2 when the maximum amount of liquid is stored in the storage chamber 43.

The liquid supply unit 20 includes a float 44, a guide 45, and a valve 46 provided in the liquid storage unit 39*b*, a first communication flow path 47*a* communicating with the second water vapor replenishment chamber 22*b*, and a first atmosphere release valve 48*a* provided in the first communication flow path 47*a*.

The float 44 floats on the liquid stored in the storage chamber 43 and is located on the second liquid surface 34*b*. The guide 45 guides the float 44 that moves along with the displacement of the second liquid surface 34*b*. Specifically, when the amount of the liquid stored in the storage chamber 43 increases and the second liquid surface 34*b* rises, the guide 45 guides the float 44 rising together with the second liquid surface 34*b* to the closed position shown by the chain double-dashed line in FIG. 2. The valve 46 is made of an elastic member such as rubber and has an annular shape, and is attached in close contact with the float 44. The float 44 and the valve 46 located at the closed position close the second vacuum flow path 23*b* by covering the opening of the second vacuum flow path 23*b*.

The liquid supply unit 20 includes a supply-side coupling flow path 50, which is an example of a coupling flow path coupled to the liquid supply flow path 39, and a supply-side branch flow path 51, which is an example of a branch flow path that branches off from the supply-side coupling flow path 50. The liquid supply unit 20 includes a collection-side coupling flow path 52 coupled to the liquid collection flow path 40, and a collection-side branch flow path 53 that branches off from the collection-side coupling flow path 52.

The supply-side coupling flow path 50 couples a first supply coupling portion 54, which is an example of a first coupling portion, and a second supply coupling portion 55, which is an example of a second coupling portion in the liquid supply flow path 39. The first supply coupling portion 54 and the second supply coupling portion 55 are provided in the downstream supply flow path 39*c*. The supply-side branch flow path 51 branches off from a third supply coupling portion 56, which is an example of a third coupling portion provided in the supply-side coupling flow path 50. The supply-side branch flow path 51 couples the third supply coupling portion 56 and the liquid storage unit 39*b*.

The collection-side coupling flow path 52 couples a first collection coupling portion 57 and a second collection coupling portion 58 in the liquid collection flow path 40. The collection-side branch flow path 53 branches off from a third collection coupling portion 59 provided in the collection-side coupling flow path 52. The collection-side branch flow path 53 couples the third collection coupling portion 59 and the liquid storage unit 39*b*.

The supply-side coupling flow path 50 may include a supply-side air bubble trap chamber 61*a*, which is an example of an air bubble trap chamber. The third supply coupling portion 56 may be provided at the upper portion of the supply-side air bubble trap chamber 61*a*. That is, the third supply coupling portion 56 may be provided at a position above the center of the supply-side air bubble trap chamber 61*a* in the vertical direction, or may be provided on the ceiling of the supply-side air bubble trap chamber 61*a*. The supply-side air bubble trap chamber 61*a* may include a supply-side inclined portion 62*a*, which is an example of an inclined portion that is inclined upward toward the third supply coupling portion 56. When the volume of the supply-side air bubble trap chamber 61*a* is larger than the volume of the supply-side coupling flow path 50 between the supply-side air bubble trap chamber 61*a* and the second supply coupling portion 55, air bubbles can be trapped efficiently.

The collection-side coupling flow path 52 may include a collection-side air bubble trap chamber 61*b*. The third collection coupling portion 59 may be provided at the upper portion of the collection-side air bubble trap chamber 61*b*. The collection-side air bubble trap chamber 61*b* may include a collection-side inclined portion 62*b* that is inclined upward toward the third collection coupling portion 59. When the volume of the collection-side air bubble trap chamber 61*b* is larger than the volume of the collection-side coupling flow path 52 between the collection-side air bubble trap chamber 61*b* and the second collection coupling portion 58, the air bubbles can be trapped efficiently.

The liquid supply unit 20 includes a supply-side opening/closing valve 64, which is an example of an opening/closing valve provided in the supply-side branch flow path 51, and a collection-side opening/closing valve 65 provided in the collection-side branch flow path 53. The supply-side opening/closing valve 64 is provided so as to be able to open/close the supply-side branch flow path 51. The collection-side opening/closing valve 65 is provided so as to be able to open/close the collection-side branch flow path 53.

The liquid supply unit 20 may include a first supply differential pressure valve 66, which is an example of a first differential pressure valve provided in the supply-side coupling flow path 50. The liquid supply unit 20 may include a first collection differential pressure valve 67 provided in the collection-side coupling flow path 52.

The liquid supply unit 20 includes an upstream supply valve 68 provided in the upstream supply flow path 39*a*, and a second supply differential pressure valve 69, which is an example of a second differential pressure valve a supply pump 70, a supply buffer 71, and a downstream supply valve 72, which are provided in the downstream supply flow path 39*c* in this order from upstream. The upstream supply valve 68 and the downstream supply valve 72 are provided so as to be able to open/close the liquid supply flow path 39.

The liquid supply unit 20 may include an upstream collection valve 73, a collection buffer 74, a collection pump 75, and a downstream collection valve 76, which are provided in the upstream collection flow path 40*a* in this order from upstream, and a second collection differential pressure valve 77 provided in the downstream collection flow path 40*c*. The upstream collection valve 73 and the downstream collection valve 76 are provided so as to be able to open/close the liquid collection flow path 40.

The first supply differential pressure valve 66 is provided in the supply-side coupling flow path 50 between the third supply coupling portion 56 and the second supply coupling portion 55. Specifically, the first supply differential pressure valve 66 is provided in the supply-side coupling flow path 50 between the supply-side air bubble trap chamber 61*a* and the second supply coupling portion 55. The first supply differential pressure valve 66 permits a flow of the liquid flowing from the third supply coupling portion 56 to the second supply coupling portion 55, and restricts a flow of the liquid flowing from the second supply coupling portion 55 to the third supply coupling portion 56.

The second supply differential pressure valve 69 is provided in the liquid supply flow path 39 between the liquid storage unit 39*b* and the second supply coupling portion 55. The second supply differential pressure valve 69 permits a flow of the liquid flowing from the liquid storage unit 39*b* to the second supply coupling portion 55, and restricts a flow of the liquid flowing from the second supply coupling portion 55 to the liquid storage unit 39*b*.

The first collection differential pressure valve 67 is provided in the collection-side coupling flow path 52 between the third collection coupling portion 59 and the second collection coupling portion 58. Specifically, the first collection differential pressure valve 67 is provided in the collection-side coupling flow path 52 between the collection-side air bubble trap chamber 61*b* and the second collection coupling portion 58. The first collection differential pressure valve 67 permits a flow of the liquid flowing from the third collection coupling portion 59 to the second collection coupling portion 58, and restricts a flow of the liquid flowing from the second collection coupling portion 58 to the third collection coupling portion 59.

The second collection differential pressure valve 77 is provided in the liquid collection flow path 40 between the collection storage unit 40*b* and the liquid storage unit 39*b*. The second collection differential pressure valve 77 permits a flow of the liquid flowing from the collection storage unit 40*b* to the liquid storage unit 39*b*, and restricts a flow of the liquid flowing from the liquid storage unit 39*b* to the collection storage unit 40*b*.

The supply pump 70 sends the liquid from the liquid storage unit 39*b* to the liquid ejection head 18. The supply pump 70 is disposed in the liquid supply flow path 39 between the first supply coupling portion 54 and the second supply coupling portion 55. In other words, the first supply coupling portion 54 is provided in the liquid supply flow path 39 downstream of the supply pump 70. The second supply coupling portion 55 is provided in the liquid supply flow path 39 upstream of the supply pump 70.

The collection pump 75 sends the liquid from the liquid ejection head 18 to the liquid storage unit 39*b*. The collection pump 75 is disposed in the liquid collection flow path 40 between the first collection coupling portion 57 and the second collection coupling portion 58. In other words, the first collection coupling portion 57 is provided in the liquid collection flow path 40 downstream of the collection pump 75. The second collection coupling portion 58 is provided in the liquid collection flow path 40 upstream of the collection pump 75.

The supply buffer 71 is provided in the liquid supply flow path 39 between the first supply coupling portion 54 and the downstream supply valve 72. The collection buffer 74 is provided in the liquid collection flow path 40 between the upstream collection valve 73 and the second collection coupling portion 58. The supply buffer 71 and the collection buffer 74 are configured to store the liquid. Each of the supply buffer 71 and the collection buffer 74 has one surface of a flexible film, and a variable volume that stores the liquid. By providing the supply buffer 71 and the collection buffer 74, it is possible to suppress fluctuations in pressure generated in the liquid ejection head 18 when the liquid flows through the liquid supply flow path 39 and the liquid collection flow path 40.

Next, the water vapor supply unit 21 that supplies the water vapor into the circulation flow path 41 including the liquid ejection head 18, the liquid supply flow path 39, and the liquid collection flow path 40 will be described. As shown in FIG. 2, the water vapor supply unit 21 may include a moisturizing liquid flow path 80 coupled to the moisturizing liquid container 29 mounted on the second mounting unit 27, and a water vapor generator 81 that stores the moisturizing liquid supplied from the moisturizing liquid container 29 to generate the water vapor. The water vapor supply unit 21 may include a second communication flow path 47*b* communicating with the water vapor generator 81, and a second atmosphere release valve 48*b* provided in the second communication flow path 47*b*. The moisturizing liquid may be water or a liquid obtained by adding a moisturizing agent to water. The water vapor generator 81 may heat the moisturizing liquid to generate the water vapor, or may generate the water vapor by ultrasonic waves. The moisturizing liquid flow path 80 couples the moisturizing liquid container 29 and the water vapor generator 81.

The water vapor supply unit 21 may include a first water vapor flow path 82*a*, a second water vapor flow path 82*b*, and a third water vapor flow path 82*c* whose upstream ends are coupled to the water vapor generator 81. The first water vapor flow path 82*a* couples the water vapor generator 81 and the first water vapor replenishment chamber 22*a*. The second water vapor flow path 82*b* couples the water vapor generator 81 and the second water vapor replenishment chamber 22*b*. The third water vapor flow path 82*c* couples the water vapor generator 81 and the third water vapor replenishment chamber 22*c*.

The water vapor supply unit 21 may include a fourth vacuum flow path 83 coupled to the water vapor generator 81 and a fourth vacuum pump 84 provided in the fourth vacuum flow path 83. The water vapor supply unit 21 may include a moisturizing liquid supply valve 85 capable of opening/closing the moisturizing liquid flow path 80. The water vapor supply unit 21 may include a first water vapor supply valve 86*a* capable of opening/closing the first water vapor flow path 82*a*, a second water vapor supply valve 86*b* capable of opening/closing the second water vapor flow path 82*b*, and a third water vapor supply valve 86*c* capable of opening/closing the third water vapor flow path 82*c*.

The water vapor supply unit 21 may include a semipermeable membrane 87 that allows gas to pass therethrough but does not allow liquid to pass therethrough. The semipermeable membrane 87 may be provided in the water vapor generator 81, for example. The water vapor supply unit 21 may supply the water vapor that has passed through the semipermeable membrane 87 to the first water vapor replenishment chamber 22*a* to the third water vapor replenishment chamber 22*c*.

Figure 3:
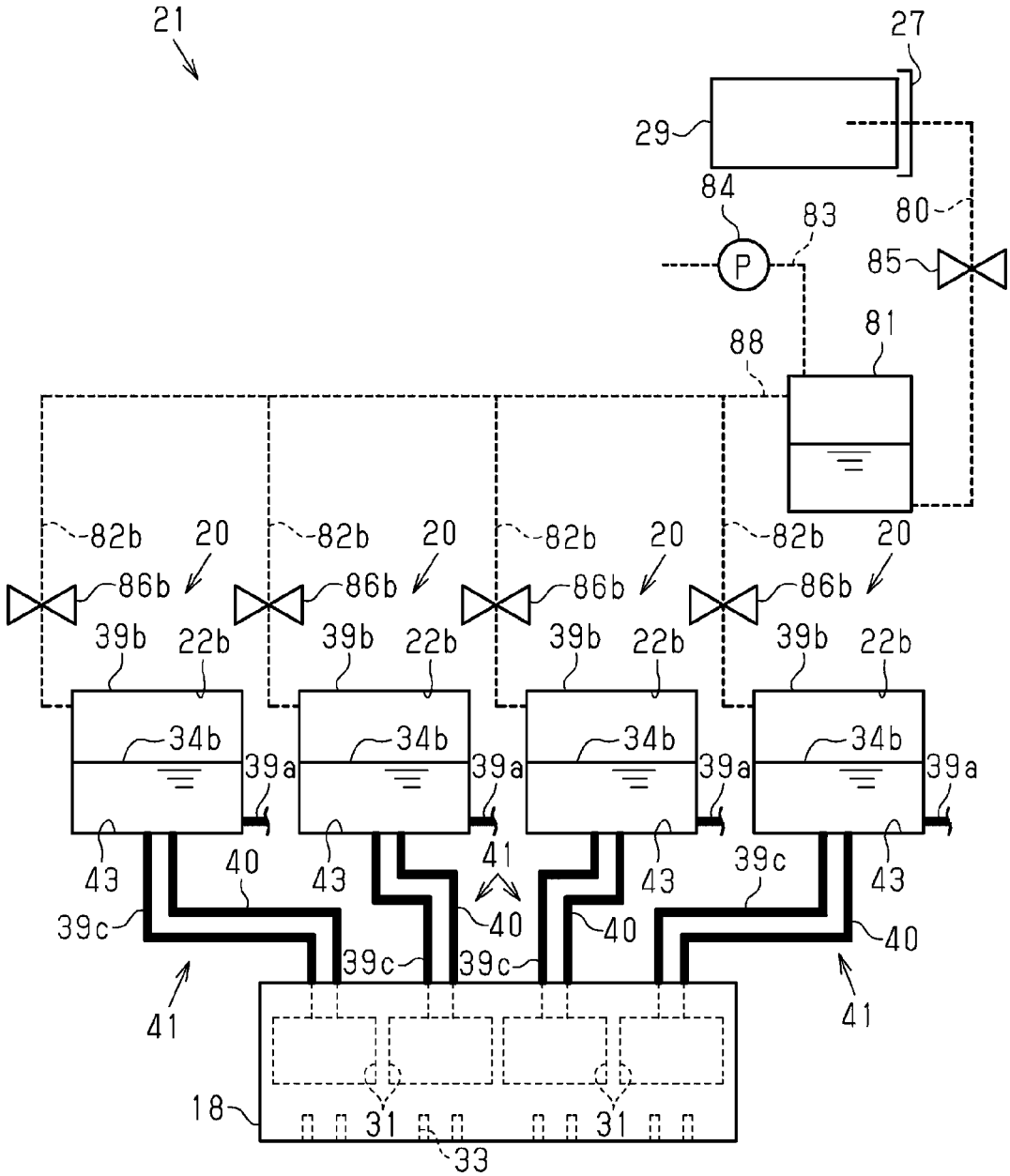
FIG. 3 is a schematic diagram of a water vapor supply unit that supplies a water vapor to a plurality of liquid supply units.

As shown in FIG. 3, the liquid ejecting apparatus 11 may include a plurality of liquid supply units 20 corresponding to the types of liquid ejected from the liquid ejection head 18. That is, the liquid ejecting apparatus 11 may include the plurality of circulation flow paths 41. The liquid ejecting apparatus 11 according to the present embodiment includes the four circulation flow paths 41 configured by the four liquid supply units 20 and the four common liquid chambers 31 provided in the liquid ejection head 18. Therefore, the liquid ejecting apparatus 11 includes the four first water vapor replenishment chamber 22*a*, the four second water vapor replenishment chamber 22*b*, the four third water vapor replenishment chamber 22*c*, the four first water vapor flow path 82*a*, the four second water vapor flow path 82*b*, the four third water vapor flow path 82*c*, the four first water vapor supply valves 86*a*, the four second water vapor supply valves 86*b*, and the four third water vapor supply valves 86*c*.

The water vapor supply unit 21 may supply the water vapor into the plurality of circulation flow paths 41 in a collective manner. For example, the water vapor supply unit 21 may couple the plurality of first water vapor flow paths 82*a*, the plurality of second water vapor flow paths 82*b*, and the plurality of third water vapor flow paths 82*c* to one water vapor generator 81. At least two flow paths of the plurality of first water vapor flow paths 82*a*, the plurality of second water vapor flow paths 82*b*, and the plurality of third water vapor flow paths 82*c* may be coupled to a confluent flow path 88 coupled to the water vapor generator 81, and may be coupled to the water vapor generator 81 via the confluent flow path 88.

Figure 4:
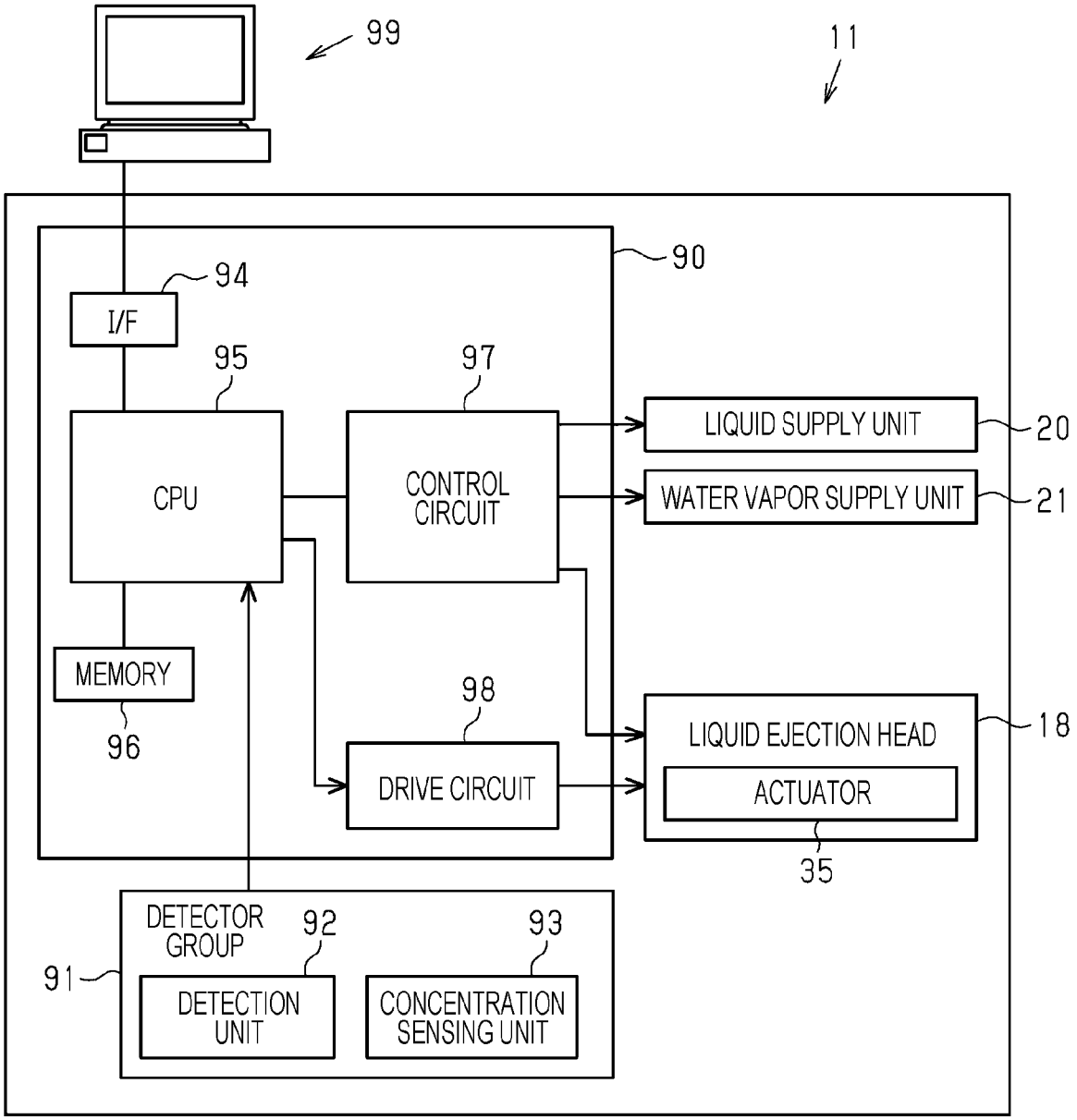
FIG. 4 is a block diagram showing an electrical configuration of the liquid ejecting apparatus.

Next, the electrical configuration of the liquid ejecting apparatus 11 will be described. As shown in FIG. 4, the liquid ejecting apparatus 11 includes a controller 90 that controls the liquid supply unit 20 and the water vapor supply unit 21, and a detector group 91 controlled by the controller 90. The detector group 91 includes a detection unit 92 that detects the vibration waveform of the pressure chamber 32 to detect a state in the pressure chamber 32, and a concentration sensing unit 93 that senses the concentration of the liquid. The detector group 91 monitors the situation inside the liquid ejecting apparatus 11. The detector group 91 outputs the detection result to the controller 90.

The liquid ejecting apparatus 11 may include the plurality of concentration sensing units 93 to sense the concentrations of the liquids in the liquid supply flow path 39 and the liquid collection flow path 40. The concentration sensing unit 93 includes, for example, a transmissive member containing a liquid, a light emitting element that emits light, and a light receiving element that receives light, and senses the concentration of the liquid by the intensity of the light received by the light receiving element. The concentration sensing unit 93 may be of a transmissive type in which the light emitting element and the light receiving element are disposed with the transmissive member interposed therebetween, and the concentration of the liquid is sensed by the intensity of light transmitted through the transmissive member. The concentration sensing unit 93 may be of a reflection type in which the concentration of the liquid is sensed by the intensity of light that is emitted from the light emitting element to enter the liquid and is reflected.

The controller 90 includes an interface unit 94, a CPU 95, a memory 96, a control circuit 97, and a drive circuit 98. The interface unit 94 transmits and receives data between a computer 99, which is an external device, and the liquid ejecting apparatus 11. The drive circuit 98 generates a drive signal for driving the actuator 35.

The CPU 95 is an arithmetic processing unit. The memory 96 is a storage device that secures an area that stores a program of the CPU 95, a work area, or the like, and includes a storage element such as a RAM or an EEPROM. The CPU 95 controls, via the control circuit 97, the liquid supply unit 20, the water vapor supply unit 21, the liquid ejection head 18, and the like according to the program stored in the memory 96.

The detection unit 92 is a circuit that detects a residual vibration of the pressure chamber 32. The controller 90 performs a nozzle inspection described below based on the detection result of the detection unit 92. The detection unit 92 may include a piezoelectric element that constitutes the actuator 35.

Next, the nozzle inspection will be described. When a voltage is applied to the actuator 35 by a signal from the drive circuit 98, the diaphragm 37 is flexibly deformed. This causes the pressure fluctuation in the pressure chamber 32. The diaphragm 37 vibrates for a while due to this fluctuation. This vibration is called a residual vibration. Detecting the state of the pressure chamber 32 and the nozzle 33 communicating with the pressure chamber 32 from the state of the residual vibration is called a nozzle inspection.

Figure 5:
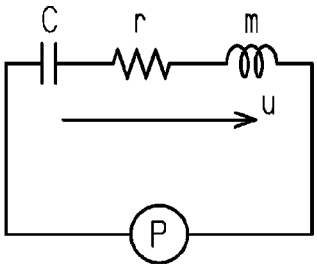
FIG. 5 is a diagram showing a calculation model of simple vibration assuming residual vibration of a diaphragm.

FIG. 5 is a diagram showing a calculation model of a simple vibration assuming the residual vibration of the diaphragm 37. When the drive circuit 98 applies a drive signal to the actuator 35, the actuator 35 expands and contracts according to the voltage of the drive signal. The diaphragm 37 bends according to the expansion and contraction of the actuator 35. As a result, the volume of the pressure chamber 32 expands and then contracts. At this time, due to the pressure generated in the pressure chamber 32, part of the liquid with which the pressure chamber 32 is filled is ejected as droplets from the nozzle 33.

During the series of operations of the diaphragm 37 described above, the diaphragm 37 freely vibrates at the natural vibration frequency determined by the shape of the flow path through which the liquid flows, the flow path resistance r due to the viscosity of the liquid, the inertance m due to the weight of the liquid in the flow path, and the compliance C of the diaphragm 37. The free vibration of the diaphragm 37 is the residual vibration.

The calculation model of the residual vibration of the diaphragm 37 shown in FIG. 5 can be expressed by the inertance m, the compliance C, and the flow path resistance r, which are described above, and the pressure P. When the step response when the pressure P is applied to the circuit of FIG. 5 is calculated for the volume velocity u, the following equations are obtained.

$$u = \frac{p}{\omega \cdot m} e^{-\omega t} \cdot \sin\omega t \tag{1}$$

$$\omega = \sqrt{\frac{1}{m \cdot C} - \alpha^2} \tag{2}$$

$$\alpha = \frac{r}{2m} \tag{3}$$

Figure 6:
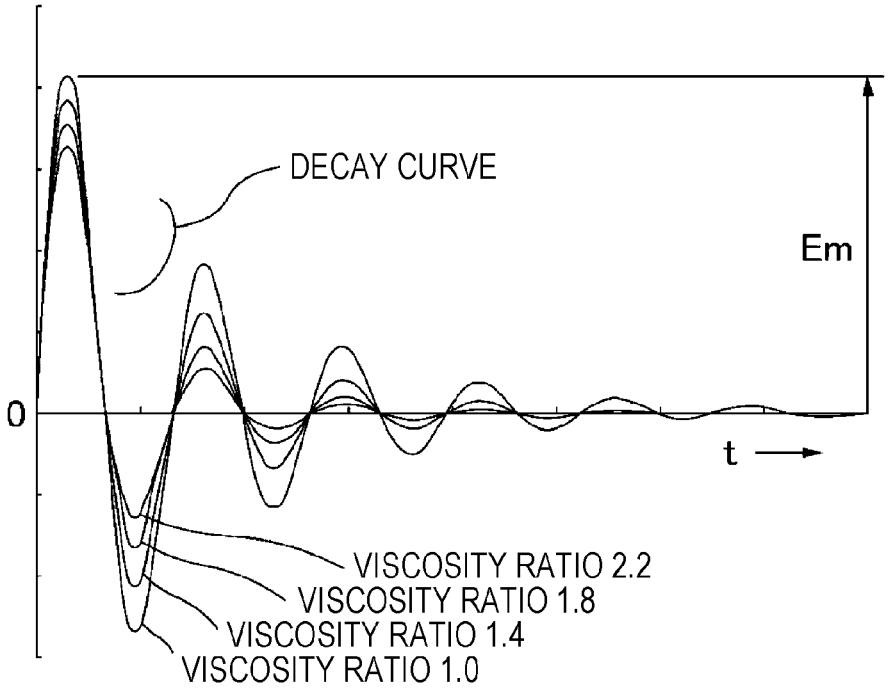
FIG. 6 is an explanatory diagram illustrating a relationship between a thickening of a liquid and a residual vibration waveform.

FIG. 6 is an explanatory diagram of the relationship between the thickening of the liquid and the residual vibration waveform. The horizontal axis of FIG. 6 represents time and the vertical axis represents the magnitude of the residual vibration. For example, when the liquid near the nozzle 33 is dried, the liquid has an increased viscosity, that is, the liquid is thickened. When the liquid is thickened, the flow path resistance r increases, so that the vibration cycle and the attenuation of the residual vibration increase.

Figure 7:
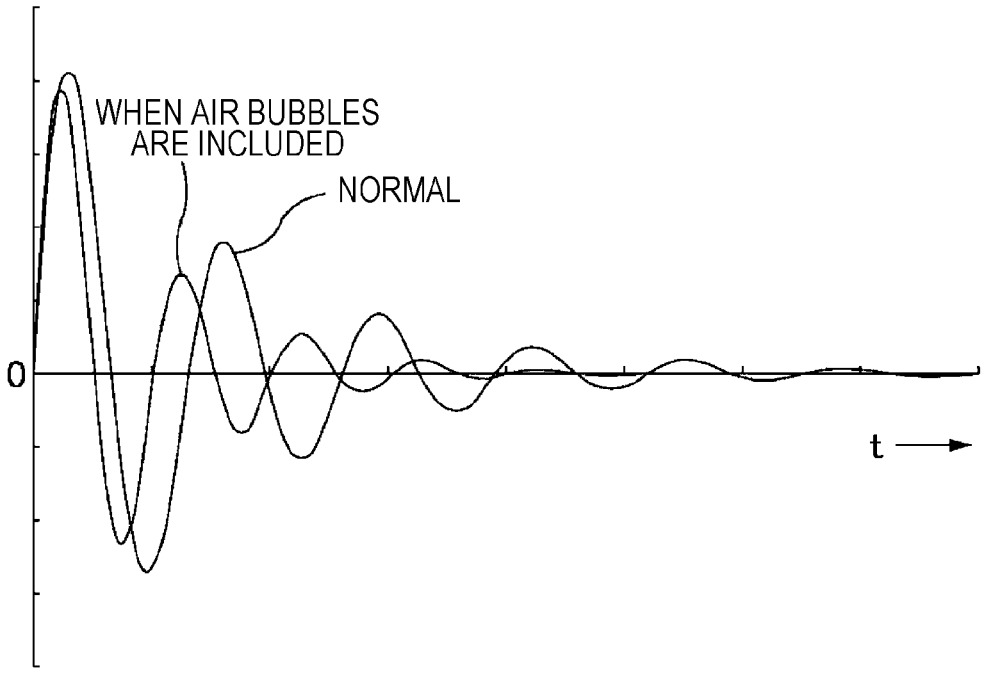
FIG. 7 is an explanatory diagram illustrating a relationship between an inclusion of air bubbles and a residual vibration waveform.

FIG. 7 is an explanatory diagram of the relationship between the inclusion of air bubbles and the residual vibration waveform. The horizontal axis of FIG. 7 represents time, and the vertical axis represents the magnitude of residual vibration. For example, when the air bubbles enter the liquid flow path or the tip of the nozzle 33, the inertance m, which is the liquid weight, is reduced by the amount of the air bubbles that has entered the liquid flow path or the tip of the nozzle 33, compared with when the state of the nozzle 33 is normal. According to Equation (2), when m decreases, the angular velocity ω increases, so that the vibration cycle is shortened. That is, the vibration frequency is heightened.

In addition, when foreign matter such as paper dust attached to the vicinity of the opening of the nozzle 33, the amounts of the liquid in the pressure chamber 32 and the seeping liquid as viewed from the diaphragm 37 increase, compared with when the state of the nozzle 33 is normal, so that it is conceivable that the inertance m increases. It is conceivable that the flow path resistance r is increased by the fibers of the paper dust attached to the vicinity of the outlet of the nozzle 33. Therefore, when the paper dust is attached to the vicinity of the opening of the nozzle 33, the frequency is lower than that during the normal ejection, and the frequency of the residual vibration is higher than that when the liquid is thickened.

As described above, the residual vibration when the liquid is thickened is different from the residual vibration when the liquid is not thickened. Therefore, the detection unit 92 detects a degree of the thickening of the liquid by detecting the vibration waveform of the pressure chamber 32.

Figure 8:
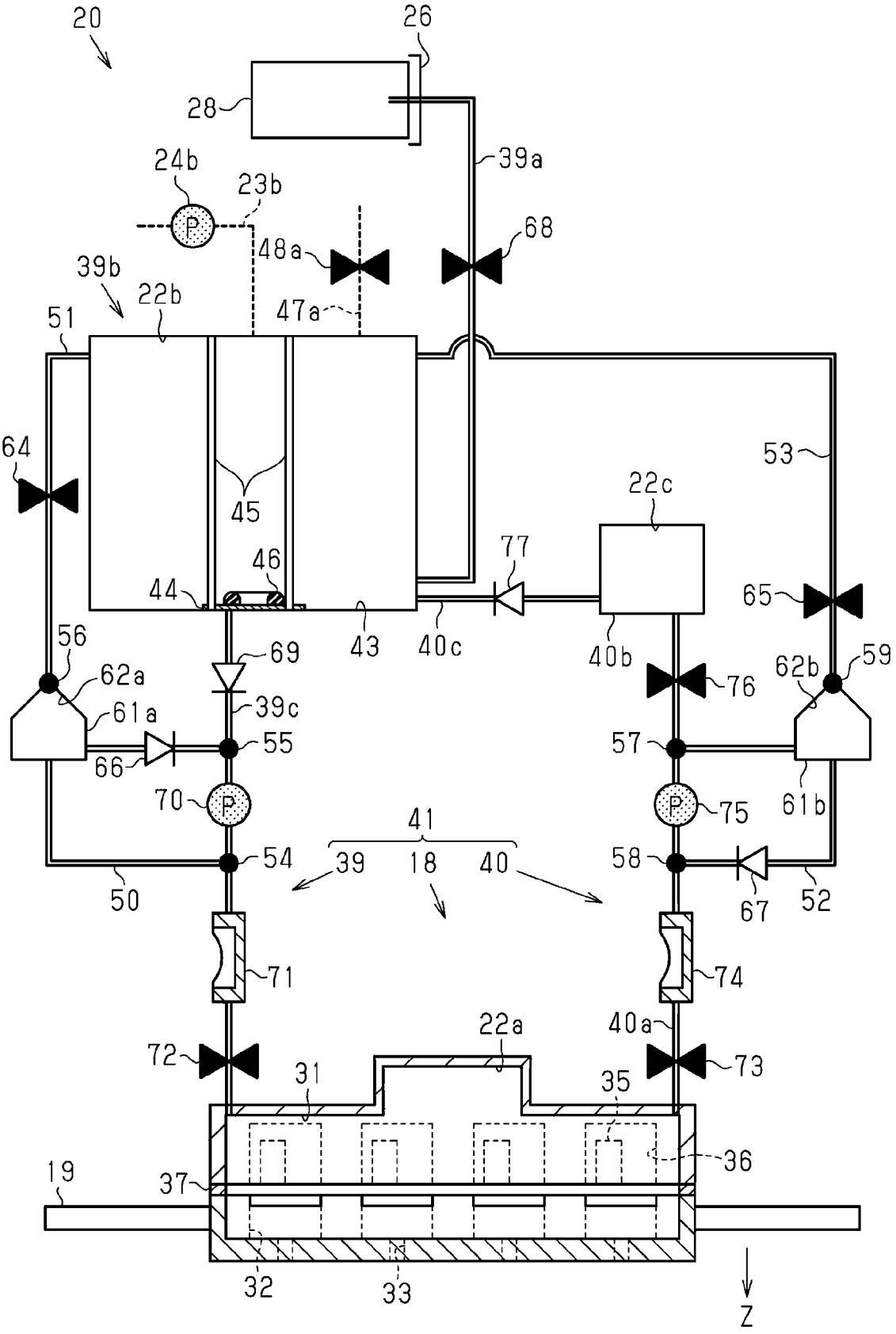
FIG. 8 is a schematic diagram of the liquid supply unit before initial filling.

Next, a method of controlling the liquid ejecting apparatus 11 when the liquid container 28 is mounted to the first mounting unit 26 and the empty liquid supply unit 20 is filled with the liquid will be described. As shown in FIG. 8, as an initial state, the liquid container 28 is mounted to the first mounting unit 26, and in the liquid ejecting apparatus 11, driving of all pumps is stopped, and all valves are closed. In the drawing, the pump in the stopped state is shaded, the valve in the closed state is shown in black, and the pump in the driven state and the valve in the open state are shown in white. Although not shown in FIG. 8, the driving of the fourth vacuum pump 84 is stopped, and the moisturizing liquid supply valve 85 and the first water vapor supply valve 86*a* to the third water vapor supply valve 86*c* are closed.

Figure 9:
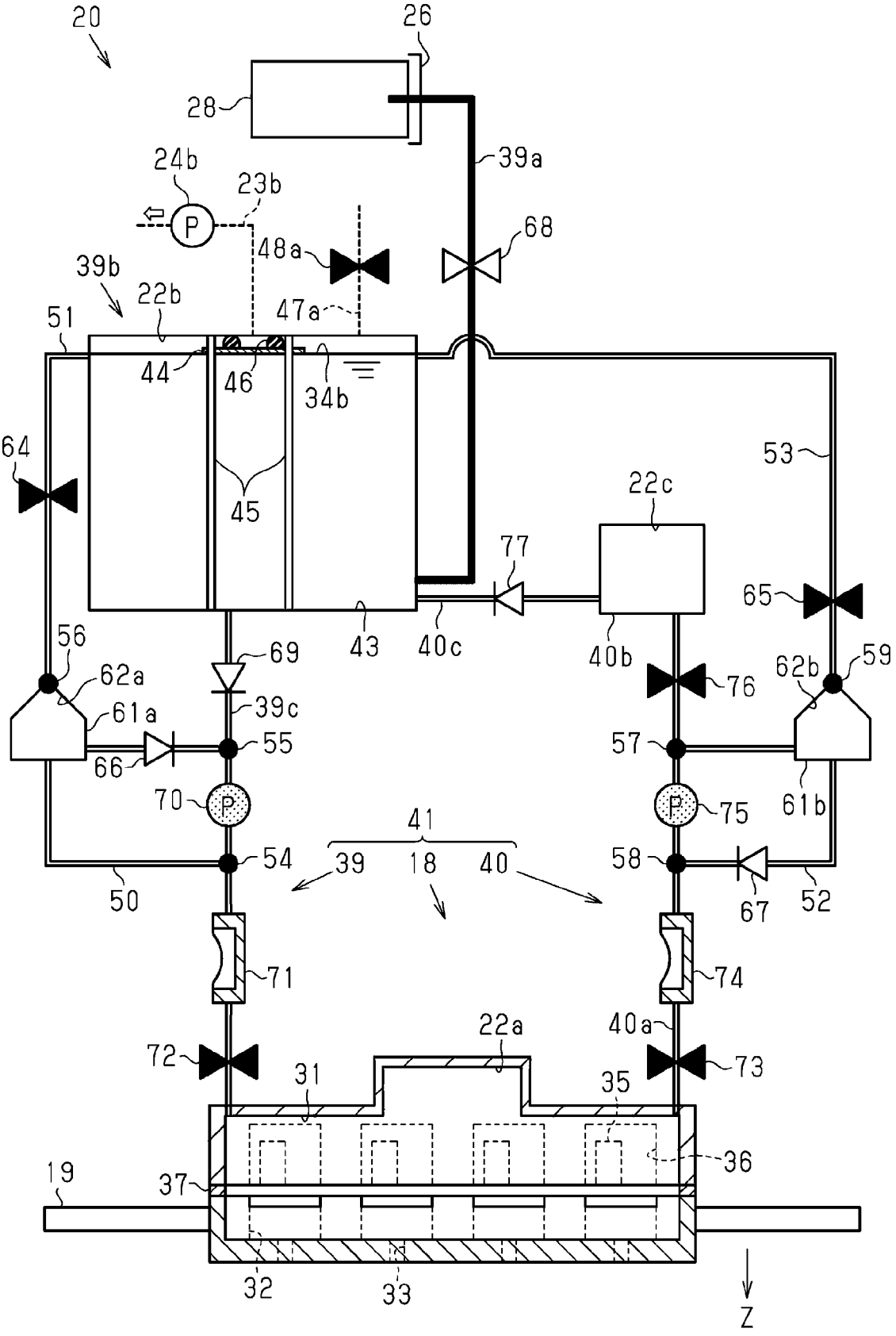
FIG. 9 is a schematic diagram of the liquid supply unit that supplies a liquid to the liquid storage unit.

As shown in FIG. 9, the controller 90 first opens the upstream supply valve 68 and drives the second vacuum pump 24*b* to decompress the inside of the liquid storage unit 39*b*. The liquid is supplied from the liquid container 28 to the liquid storage unit 39*b* via the upstream supply flow path 39*a*. When the second liquid surface 34*b* in the storage chamber 43 rises and the float 44 is located at the closed position, the valve 46 and the float 44 close the second vacuum flow path 23*b*, and the rise of the second liquid surface 34*b* stops. The controller 90 stops the driving of the second vacuum pump 24*b* when the supply time elapses after driving the second vacuum pump 24*b*. The supply time is a time required to fill the empty liquid storage unit 39*b* with the liquid supplied from the liquid container 28.

Figure 10:
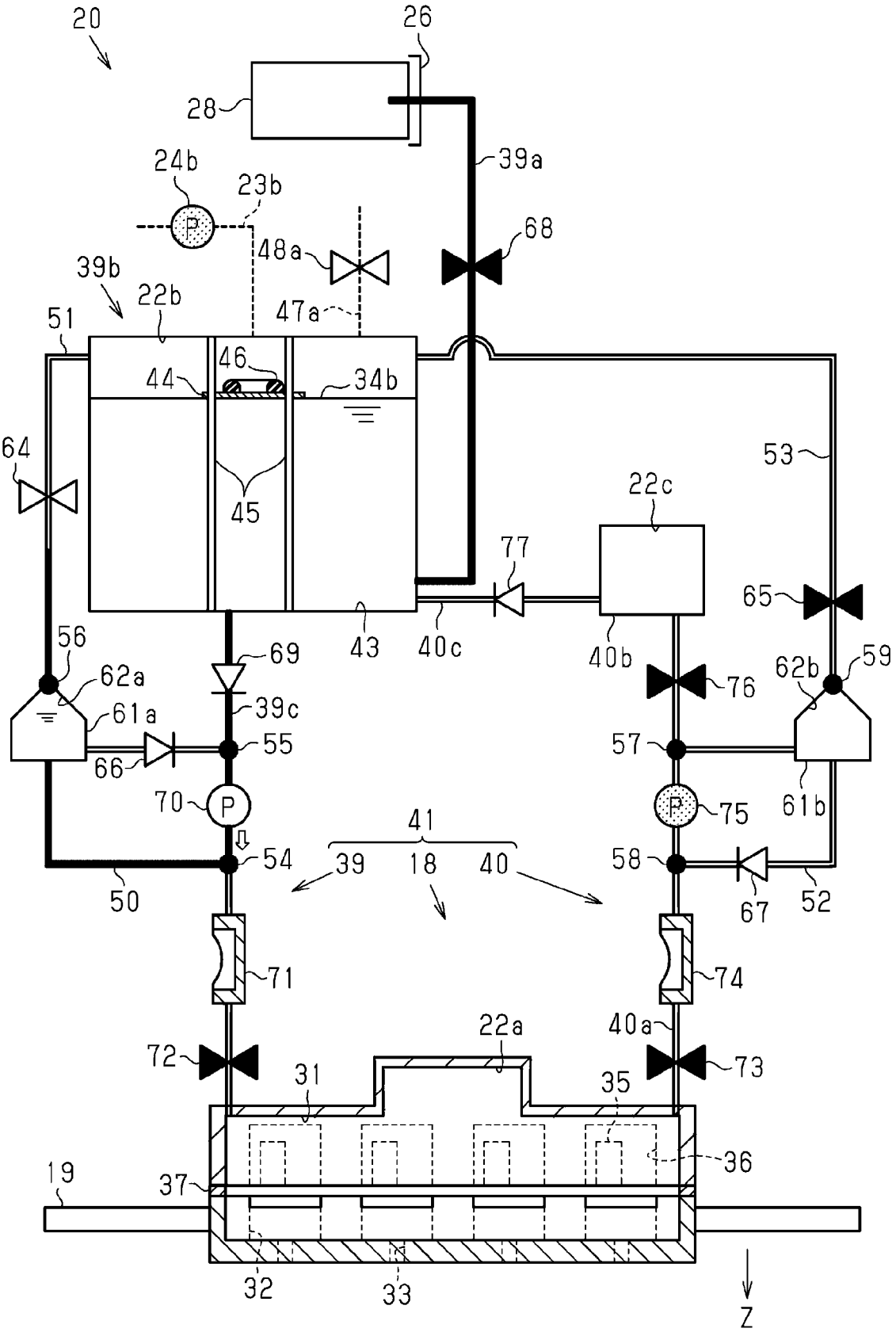
FIG. 10 is a schematic diagram of the liquid supply unit in which a supply-side opening/closing valve is opened and a supply pump is driven.

As shown in FIG. 10, subsequently, the controller 90 closes the upstream supply valve 68, opens the first atmosphere release valve 48*a* and the supply-side opening/closing valve 64, and drives the supply pump 70. That is, the controller 90 drives the supply pump 70 in a state where the supply-side opening/closing valve 64 is opened. As a result, the liquid stored in the liquid storage unit 39*b* passes through the downstream supply flow path 39*c* and flows from the first supply coupling portion 54 into the supply-side coupling flow path 50. The liquid with which the supply-side air bubble trap chamber 61*a* is filled flows into the supply-side branch flow path 51 from the third supply coupling portion 56.

The controller 90 closes the supply-side opening/closing valve 64 after the first time elapses after driving the supply pump 70. The first time is a time required to fill, with the liquid, the downstream supply flow path 39*c* between the liquid storage unit 39*b* and the first supply coupling portion 54, and the supply-side coupling flow path 50 between the first supply coupling portion 54 and the third supply coupling portion 56 by driving the supply pump 70. At this time, air may remain in the supply-side branch flow path 51. That is, when the supply-side opening/closing valve 64 is closed before the liquid flowing through the supply-side branch flow path 51 reaches the liquid storage unit 39*b*, air remains in the supply-side branch flow path 51.

Figure 11:
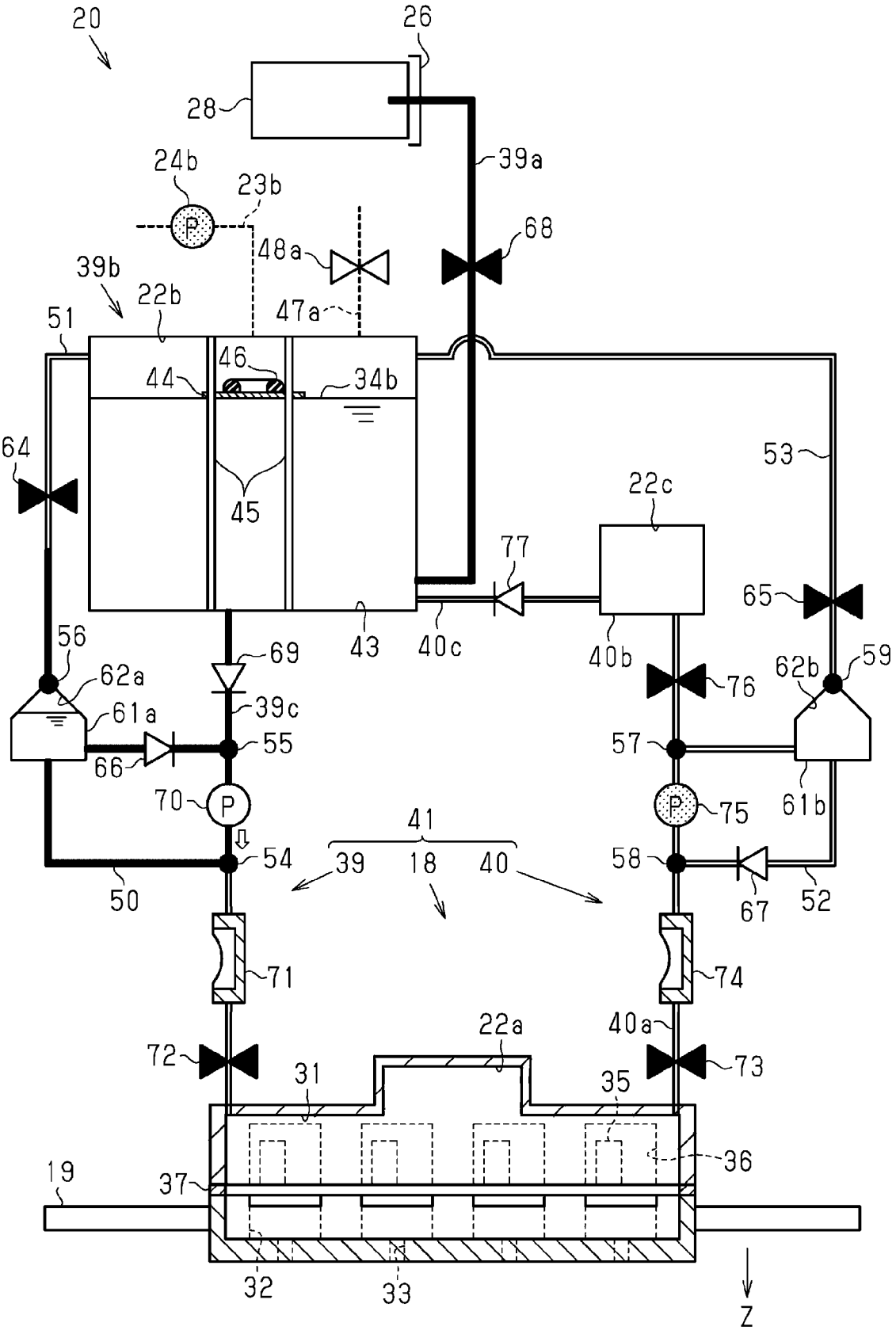
FIG. 11 is a schematic diagram of the liquid supply unit in which the supply-side opening/closing valve is closed and the supply pump is driven.

As shown in FIG. 11, when the supply-side opening/closing valve 64 is closed, the liquid circulates through the liquid supply flow path 39 between the second supply coupling portion 55 and the first supply coupling portion 54, and through the supply-side coupling flow path 50. As a result, the air bubbles remaining between the supply-side air bubble trap chamber 61*a* and the second supply coupling portion 55 are collected in the supply-side air bubble trap chamber 61*a*.

Figure 12:
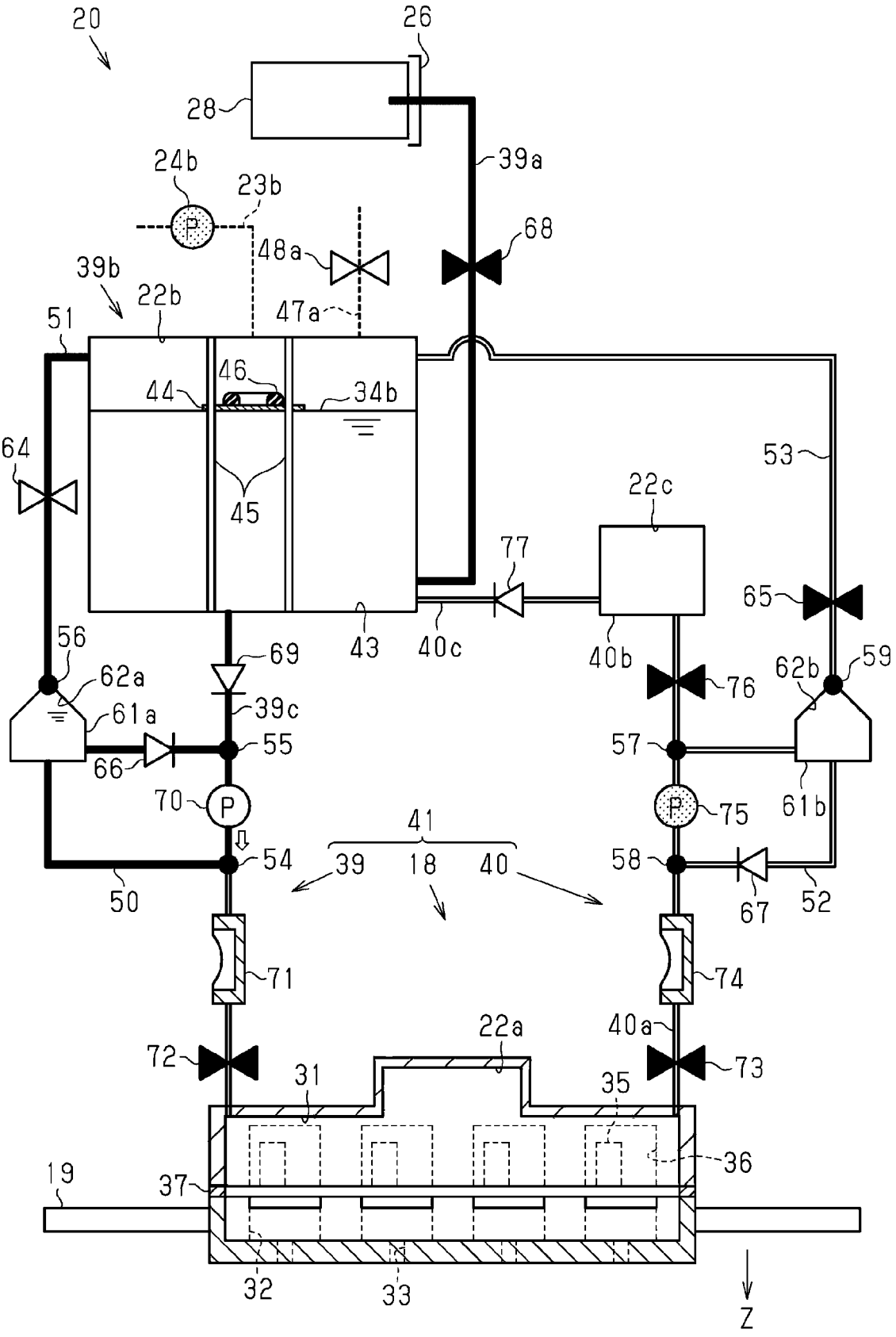
FIG. 12 is a schematic diagram of the liquid supply unit in which the supply-side opening/closing valve is opened and the supply pump is driven.

As illustrated in FIG. 12, the controller 90 opens the supply-side opening/closing valve 64 after the second time has elapsed since the supply-side opening/closing valve 64 was closed. The second time is a time longer than the time required for the liquid to go around through the liquid supply flow path 39 between the second supply coupling portion 55 and the first supply coupling portion 54, and through the supply-side coupling flow path 50. Specifically, the second time is a time longer than the time obtained by dividing the sum of the length of the liquid supply flow path 39 from the second supply coupling portion 55 to the first supply coupling portion 54 and the length of the supply-side coupling flow path 50 by the liquid flow velocity.

When the supply-side opening/closing valve 64 is opened, the liquid in the liquid storage unit 39*b* passes through the downstream supply flow path 39*c*, flows from the first supply coupling portion 54 into the supply-side coupling flow path 50, and returns from the third supply coupling portion 56 to the liquid storage unit 39*b* via the supply-side branch flow path 51. Since the third supply coupling portion 56 is located above the supply-side air bubble trap chamber 61*a*, the air bubbles collected in the supply-side air bubble trap chamber 61*a* are pushed by the liquid and sent to the liquid storage unit 39*b*.

In this way, the liquid supply unit 20 traps the air bubbles in the supply-side air bubble trap chamber 61*a* during the period until the second time has elapsed since the supply-side opening/closing valve 64 was closed. After the second time elapses, the liquid supply unit 20 collects the air bubbles trapped in the supply-side air bubble trap chamber 61*a* in the liquid storage unit 39*b* through the supply-side branch flow path 51 by opening the supply-side opening/closing valve 64.

Figure 13:
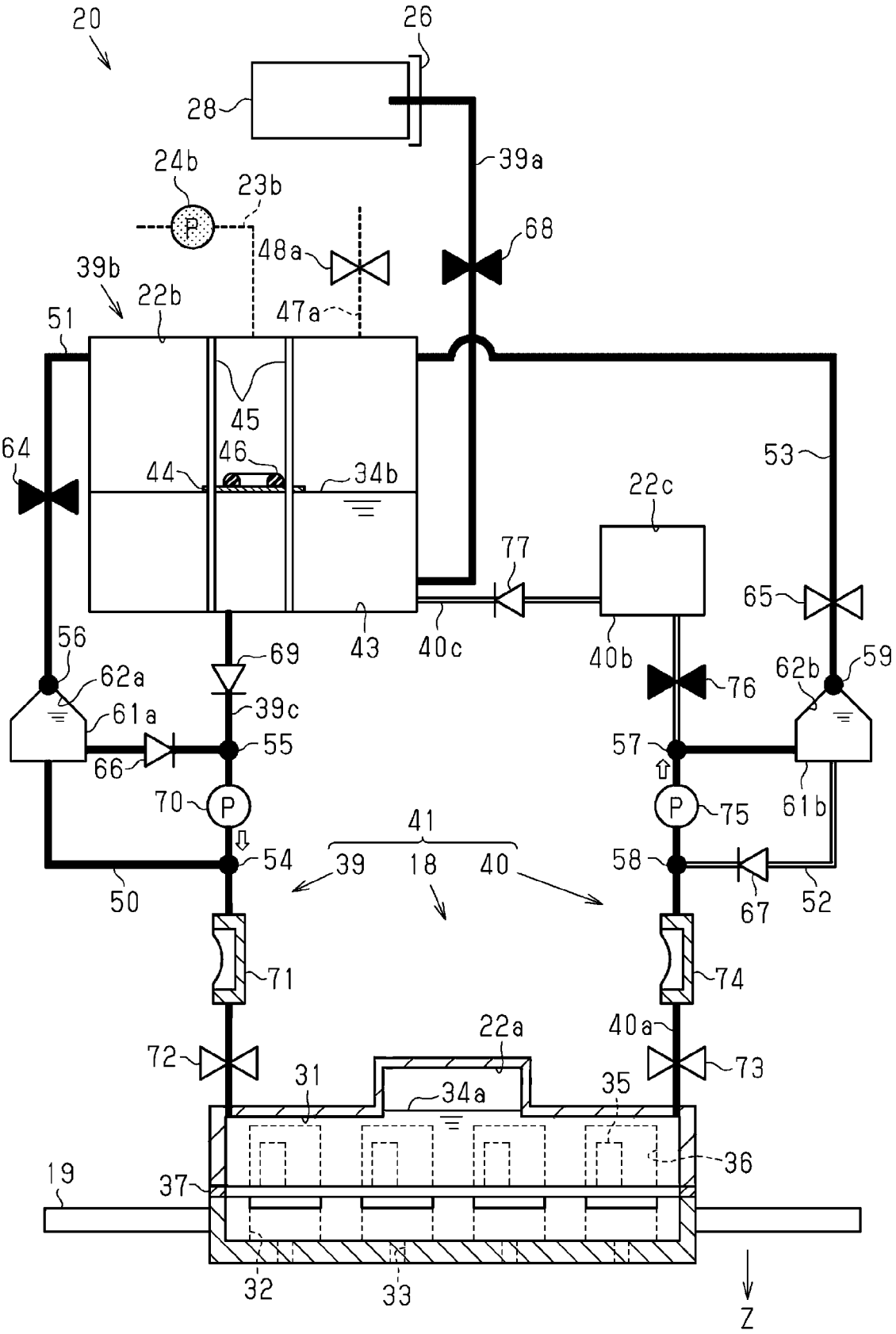
FIG. 13 is a schematic diagram of the liquid supply unit in which a collection-side opening/closing valve is opened and a collection pump is driven.

As shown in FIG. 13, after the third time has elapsed since the supply-side opening/closing valve 64 was opened, the controller 90 closes the supply-side opening/closing valve 64, opens the downstream supply valve 72, the upstream collection valve 73, and the collection-side opening/closing valve 65, and drives the collection pump 75. The third time may be shorter than the first time. The liquid flows through the downstream supply flow path 39*c* from the first supply coupling portion 54 to the liquid ejection head 18. The liquid passes through the liquid ejection head 18 and the liquid collection flow path 40, flows from the first collection coupling portion 57 into the collection-side coupling flow path 52, and fills the collection-side air bubble trap chamber 61*b*. The liquid flows from the third collection coupling portion 59 into the collection-side branch flow path 53.

Figure 14:
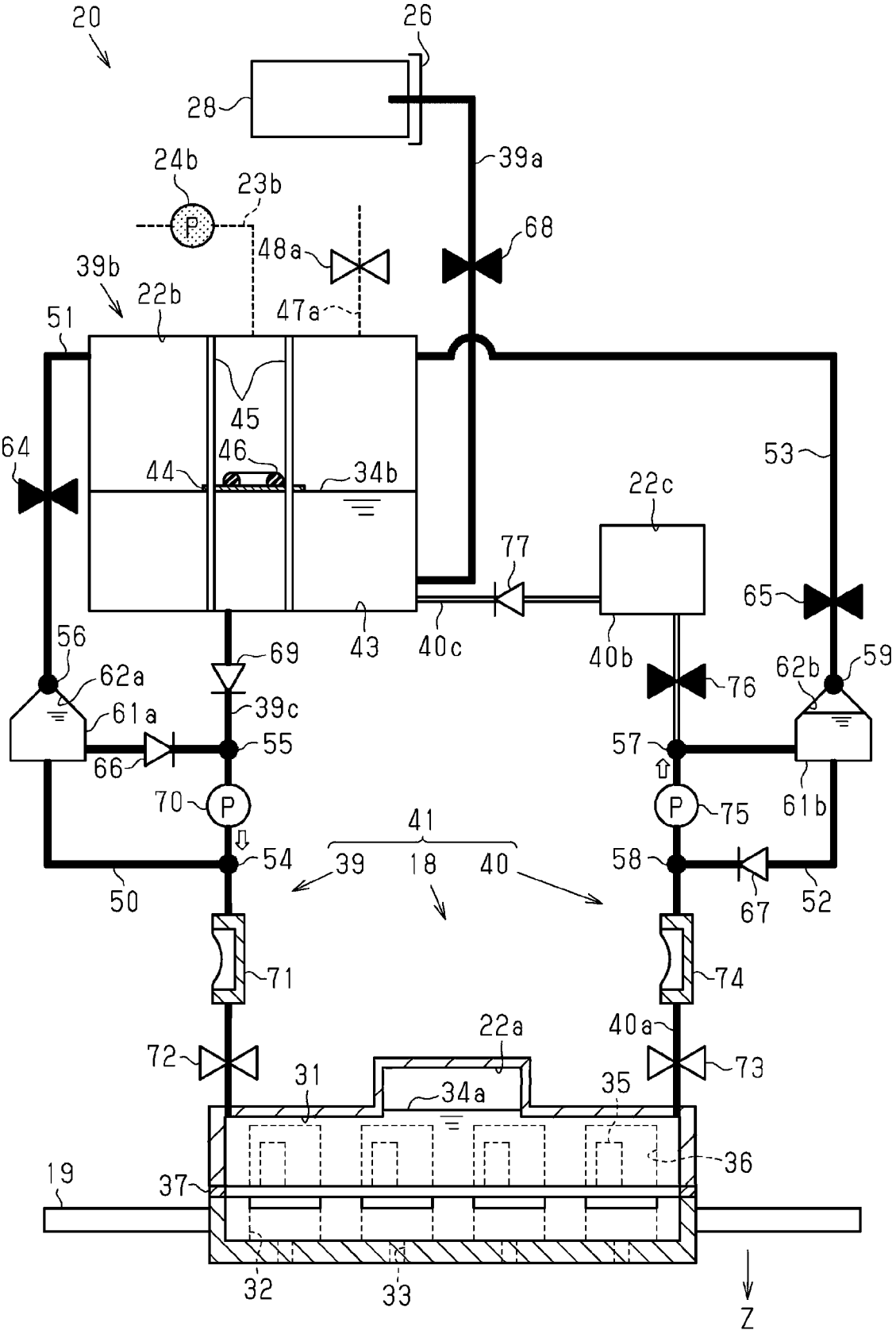
FIG. 14 is a schematic diagram of the liquid supply unit in which the collection-side opening/closing valve is closed and the collection pump is driven.

As shown in FIG. 14, the controller 90 closes the collection-side opening/closing valve 65 after the fourth time has elapsed since the collection pump 75 was driven. The fourth time is a time required to fill the collection-side air bubble trap chamber 61*b* with the liquid by driving the supply pump 70 and the collection pump 75.

When the collection-side opening/closing valve 65 is closed, the liquid circulates through the liquid collection flow path 40 between the second collection coupling portion 58 and the first collection coupling portion 57, and through the collection-side coupling flow path 52. As a result, the air bubbles remaining between the collection-side air bubble trap chamber 61*b* and the second collection coupling portion 58 are collected in the collection-side air bubble trap chamber 61*b*.

Figure 15:
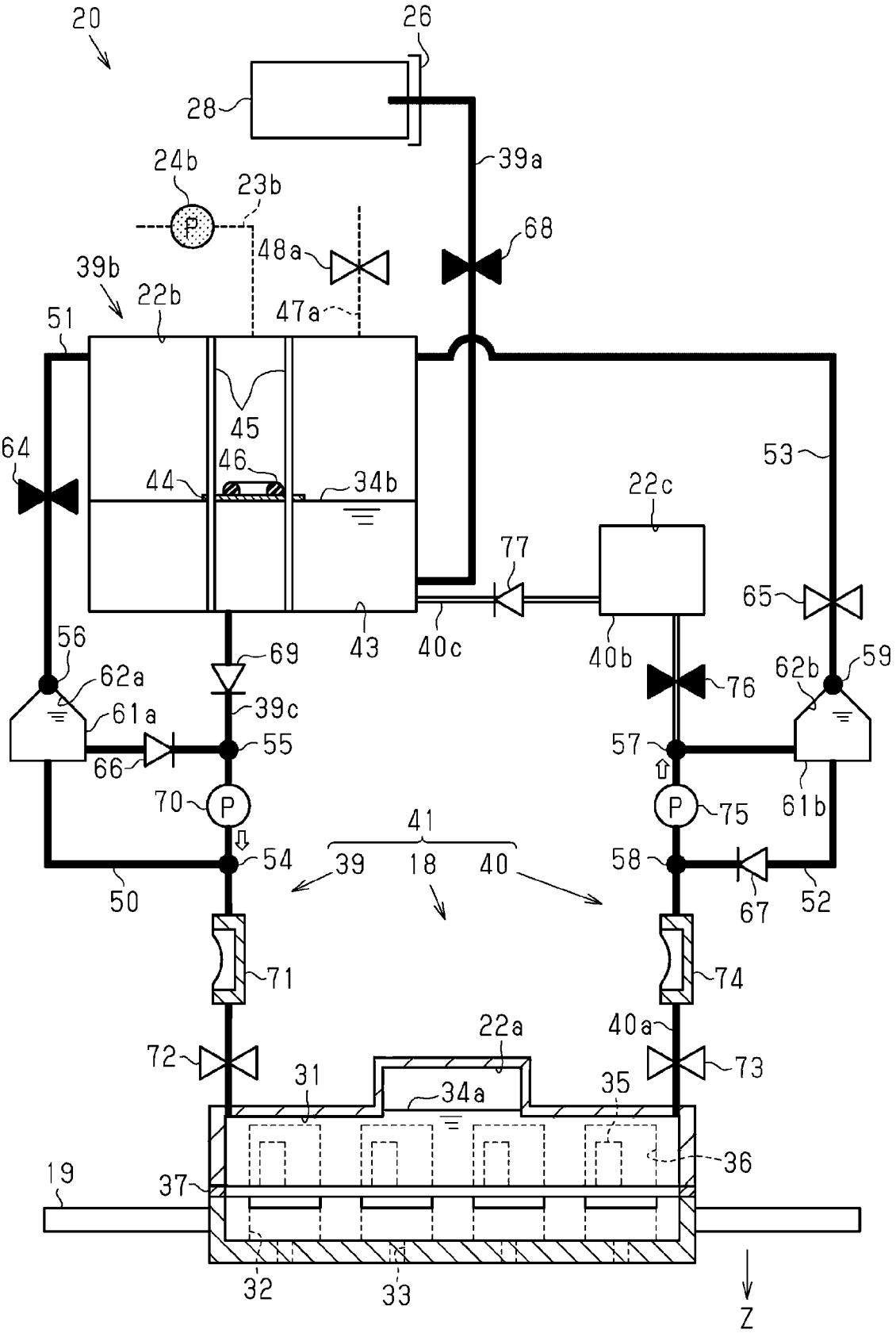
FIG. 15 is a schematic diagram of the liquid supply unit in which the collection-side opening/closing valve is opened and the collection pump is driven.

As shown in FIG. 15, the controller 90 opens the collection-side opening/closing valve 65 after the fifth time has elapsed since the collection-side opening/closing valve 65 was closed. The fifth time is a time longer than the time required for the liquid to go around through the liquid collection flow path 40 between the second collection coupling portion 58 and the first collection coupling portion 57, and through the collection-side coupling flow path 52. Specifically, the fifth time is longer than the time obtained by dividing the sum of the length of the liquid collection flow path 40 from the second collection coupling portion 58 to the first collection coupling portion 57 and the length of the collection-side coupling flow path 52 by the flow velocity of the liquid.

When the collection-side opening/closing valve 65 is opened, the liquid flowing through the liquid collection flow path 40 flows into the collection-side coupling flow path 52 from the first collection coupling portion 57, and returns from the third collection coupling portion 59 to the liquid storage unit 39*b* via the collection-side branch flow path 53. Since the third collection coupling portion 59 is located above the collection-side air bubble trap chamber 61*b*, the air bubbles collected in the collection-side air bubble trap chamber 61*b* are pushed by the liquid and sent to the liquid storage unit 39*b*.

Figure 16:
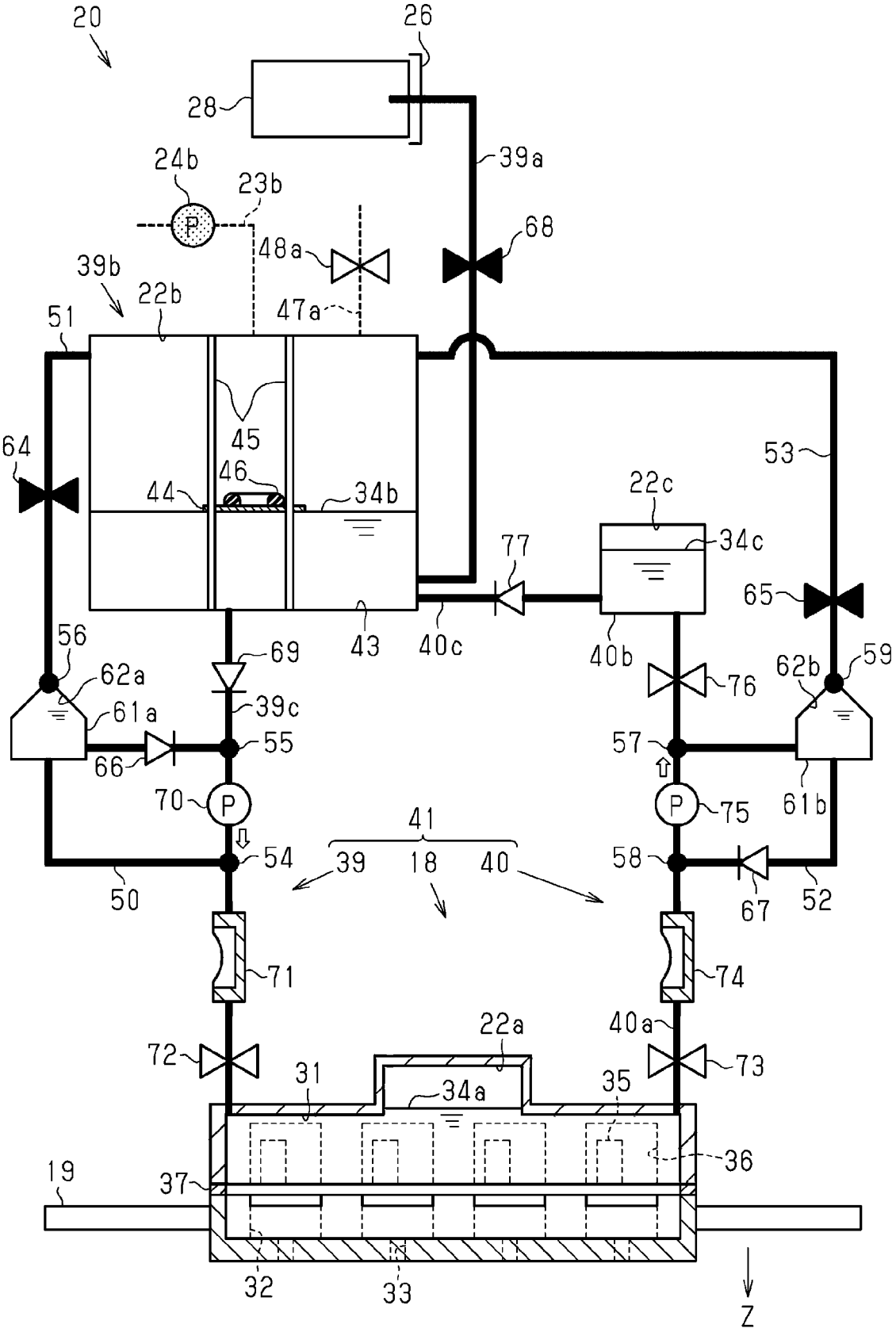
FIG. 16 is a schematic diagram of the liquid supply unit in which a downstream collection valve is opened and the collection pump is driven.

As shown in FIG. 16, after the sixth time has elapsed since the collection-side opening/closing valve 65 was opened, the controller 90 closes the collection-side opening/closing valve 65 and opens the downstream collection valve 76. As a result, the liquid collection flow path 40 downstream of the first collection coupling portion 57 is filled with the liquid.

The functions of this embodiment will be described. The controller 90 controls the operations of the supply pump 70 and the supply-side opening/closing valve 64, and fills the supply-side coupling flow path 50 and the supply-side branch flow path 51 with the liquid with a combination of the driving of the supply pump 70 and the opening/closing operation of the supply-side opening/closing valve 64. The controller 90 drives the supply pump 70 and opens/closes the supply-side opening/closing valve 64, repeatedly. That is, the controller 90 drives the supply pump 70 in a state where the supply-side opening/closing valve 64 is opened, and fills part of the supply-side coupling flow path 50 with the liquid. Subsequently, the controller 90 drives the supply pump 70 in a state where the supply-side opening/closing valve 64 is closed to collect the air bubbles remaining in the supply-side coupling flow path 50 into the supply-side air bubble trap chamber 61*a*, and drives the supply pump 70 in a state where the supply-side opening/closing valve 64 is opened again to move the air bubbles in the supply-side air bubble trap chamber 61*a* into the liquid storage unit 39*b*.

The controller 90 controls the operations of the collection pump 75 and the collection-side opening/closing valve 65, and fills the collection-side coupling flow path 52 and the collection-side branch flow path 53 with the liquid with a combination of the driving of the collection pump 75 and the opening/closing operation of the collection-side opening/closing valve 65. The controller 90 drives the collection pump 75 and opens/closes the collection-side opening/closing valve 65, repeatedly. That is, the controller 90 drives the collection pump 75 in a state where the collection-side opening/closing valve 65 is opened, drives the collection pump 75 in a state where the collection-side opening/closing valve 65 is closed, and drives the collection pump 75 in a state where the collection-side opening/closing valve 65 is opened again.

As shown in FIG. 16, the liquid ejecting apparatus 11 ejects the liquid from the liquid ejection head 18 in a state where the liquid supply unit 20 is filled with the liquid and performs printing. When the controller 90 drives the supply pump 70 and the collection pump 75, the liquid circulates through the liquid storage unit 39*b*, the downstream supply flow path 39*c*, the liquid ejection head 18, and the liquid collection flow path 40.

When the amount of liquid sent by the supply pump 70 per unit time is larger than the sum of the amount of liquid discharged by the liquid ejection head 18 and the amount of liquid sent by the collection pump 75, part of the liquid sent by the supply pump 70 flows into the supply-side coupling flow path 50 from the first supply coupling portion 54. That is, the liquid flows in the supply-side coupling flow path 50, allowing the pressure increase in the downstream supply flow path 39*c* to be suppressed. Therefore, the pressure of the liquid supplied to the liquid ejection head 18 can be stabilized by providing the supply-side coupling flow path 50.

When the amount of liquid sent by the collection pump 75 per unit time is larger than the difference obtained by subtracting the amount of liquid discharged by the liquid ejection head 18 from the amount of liquid sent by the supply pump 70, the liquid in the collection-side coupling flow path 52 is drawn into the liquid collection flow path 40 from the second collection coupling portion 58. That is, the liquid flows in the collection-side coupling flow path 52, allowing the pressure of the liquid in the liquid collection flow path 40 and the liquid ejection head 18 to be stabilized.

As shown in FIG. 2, the water vapor supply unit 21 adds the water vapor to the liquid with which the liquid ejection head 18 and the liquid supply unit 20 is filled. First, the controller 90 supplies the moisturizing liquid stored in the moisturizing liquid container 29 to the water vapor generator 81. The controller 90 drives the fourth vacuum pump 84 in a state where the moisturizing liquid supply valve 85 is open and the second atmosphere release valve 48*b* is closed. As a result, the moisturizing liquid is supplied from the moisturizing liquid container 29 to the water vapor generator 81 via the moisturizing liquid flow path 80. When the amount of moisturizing liquid required to generate the water vapor is supplied to the water vapor generator 81, the controller 90 stops driving the fourth vacuum pump 84, and closes the moisturizing liquid supply valve 85.

The controller 90 may control the amount of the water vapor to be supplied into the circulation flow path 41 in accordance with the liquid viscosity estimated by detecting the vibration waveform of the pressure chamber 32. When the liquid in the liquid ejection head 18 is thickened, and the liquid viscosity detected by nozzle inspection is higher than the threshold, the controller 90 may increase the amount of the water vapor to be supplied into the first water vapor replenishment chamber 22*a* as compared with the case where the viscosity is lower than the threshold.

The controller 90 opens the first water vapor supply valve 86*a* and the second atmosphere release valve 48*b* to drive the first vacuum pump 24*a*. As a result, the water vapor is supplied into the first water vapor replenishment chamber 22*a*, and the water vapor is taken into the liquid from the first liquid surface 34*a*.

The controller 90 may control the amount of the water vapor to be supplied into the circulation flow path 41 according to the concentration sensed by the concentration sensing unit 93. When the concentration of the liquid in the liquid supply flow path 39 sensed by the concentration sensing unit 93 is higher than the threshold, the controller 90 may increase the amount of the water vapor to be supplied into the second water vapor replenishment chamber 22*b* as compared with the case where the concentration is lower than the threshold.

The controller 90 closes the first atmosphere release valve 48*a*, opens the second water vapor supply valve 86*b* and the second atmosphere release valve 48*b*, and drives the second vacuum pump 24*b*. As a result, the water vapor is supplied into the second water vapor replenishment chamber 22*b*, and the water vapor is taken into the liquid from the second liquid surface 34*b*.

When the concentration of the liquid in the liquid collection flow path 40 sensed by the concentration sensing unit 93 is higher than the threshold, the controller 90 may increase the amount of the water vapor to be supplied into the third water vapor replenishment chamber 22*c* as compared with the case where the concentration is lower than the threshold.

The controller 90 opens the third water vapor supply valve 86*c* and the second atmosphere release valve 48*b* to drive the third vacuum pump 24*c*. As a result, the water vapor is supplied into the third water vapor replenishment chamber 22*c*, and the water vapor is taken into the liquid from the third liquid surface 34*c*.

Next, a case where the liquid ejection head 18 is removed from the loader 19 in a state where the liquid supply unit 20 is filled with the liquid will be described. When the liquid ejection head 18 is removed, the controller 90 collects the liquid in the liquid ejection head 18 into the liquid storage unit 39*b* through at least one of the liquid supply flow path 39 and the liquid collection flow path 40.

Figure 17:
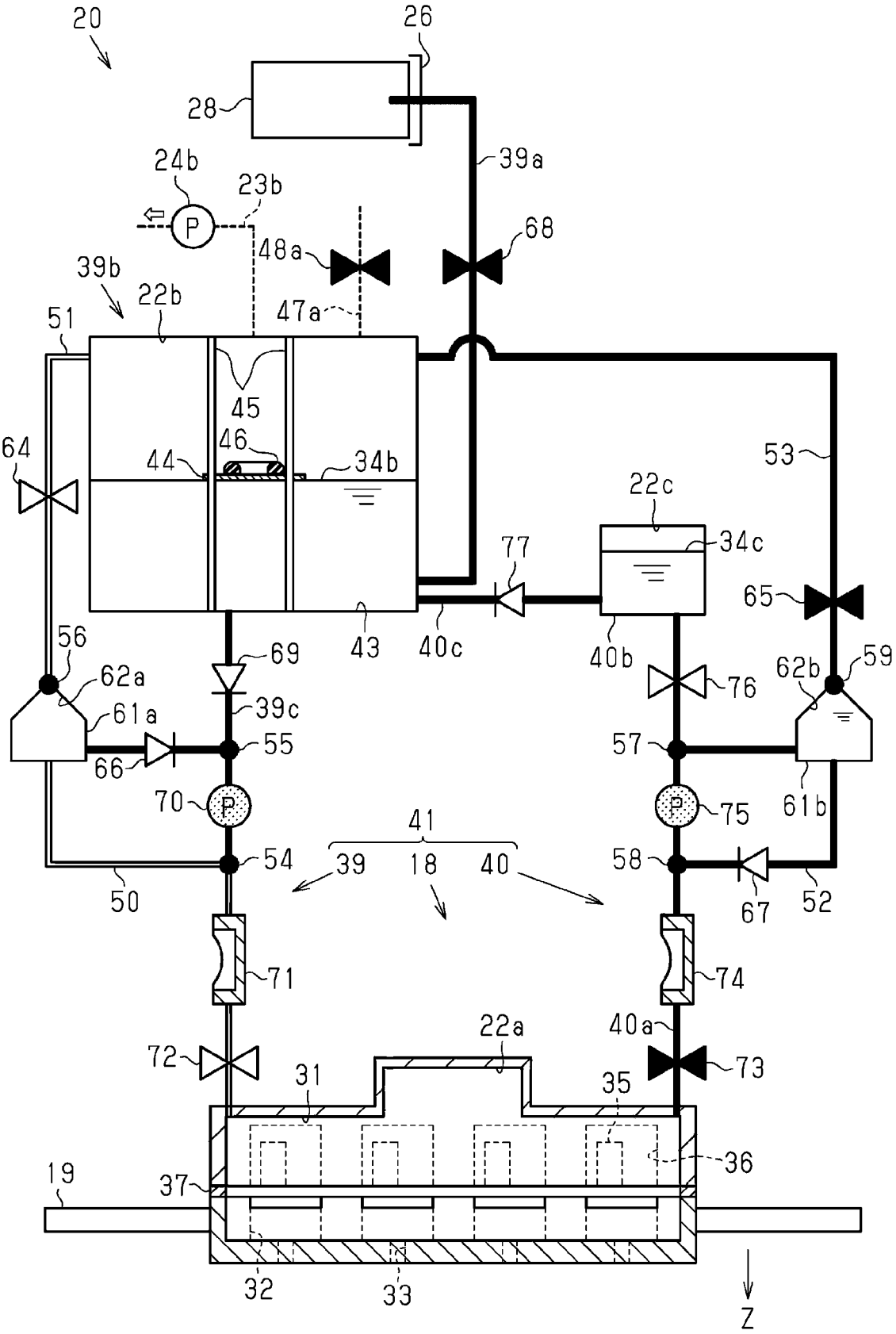
FIG. 17 is a schematic diagram of a liquid supply unit when returning the liquid of a liquid ejection head to the liquid storage unit.

As shown in FIG. 17, when the liquid passes through the liquid supply flow path 39, the controller 90 opens the supply-side opening/closing valve 64 and the downstream supply valve 72, and closes the first atmosphere release valve 48*a*, the collection-side opening/closing valve 65, the upstream supply valve 68, and the upstream collection valve 73. The controller 90 stops driving the supply pump 70 and the collection pump 75, and drives the second vacuum pump 24*b*. The liquid of the liquid ejection head 18 flows through the liquid supply flow path 39 to the first supply coupling portion 54, flows from the first supply coupling portion 54 into the supply-side coupling flow path 50, and is collected in the liquid storage unit 39*b* via the supply-side branch flow path 51.

When the liquid passes through the liquid collection flow path 40, the controller 90 closes the first atmosphere release valve 48*a*, the supply-side opening/closing valve 64, the upstream supply valve 68, the downstream supply valve 72, and the downstream collection valve 76, and opens the upstream collection valve 73 and the collection-side opening/closing valve 65. The controller 90 stops driving the supply pump 70 and the collection pump 75, and drives the second vacuum pump 24*b*. The liquid of the liquid ejection head 18 flows through the liquid collection flow path 40 to the first collection coupling portion 57, flows from the first collection coupling portion 57 into the collection-side coupling flow path 52, and is collected in the liquid storage unit 39*b* via the collection-side branch flow path 53.

When the liquid in the liquid ejection head 18 is collected, the liquid ejection head 18 is removed from the loader 19. The liquid ejection head 18 may be detachably provided in the liquid supply flow path 39 and the liquid collection flow path 40.

The effects of this embodiment will be described.

(1) The supply-side coupling flow path 50 couples the first supply coupling portion 54 and the second supply coupling portion 55 in the liquid supply flow path 39. The supply-side branch flow path 51 couples the supply-side coupling flow path 50 and the liquid storage unit 39*b*. For this reason, when the supply pump 70 is driven in a state where the supply-side opening/closing valve 64 is opened, the liquid sent from the liquid storage unit 39*b* to the liquid supply flow path 39 flows into the supply-side coupling flow path 50 from the first supply coupling portion 54, and returns to the liquid storage unit 39*b* via the supply-side branch flow path 51. That is, the supply-side branch flow path 51 is filled with the liquid, and part of the supply-side coupling flow path 50 is filled with the liquid. Therefore, it is possible to easily fill the supply-side coupling flow path 50 with the liquid, compared with the case where filling the supply-side branch flow path 51 with the liquid and filling the supply-side coupling flow path 50 with the liquid are performed individually.

(2) When the supply pump 70 is driven in a state where the supply-side opening/closing valve 64 is open, the air bubbles located between the third supply coupling portion 56 and the second supply coupling portion 55 in the supply-side coupling flow path 50 remain, while the air bubbles located between the first supply coupling portion 54 and the third supply coupling portion 56 in the supply-side coupling flow path 50 are discharged. When the supply pump 70 is driven in a state where the supply-side opening/closing valve 64 is closed, the air bubbles remaining in the supply-side coupling flow path 50 circulate through the liquid supply flow path 39 between the second supply coupling portion 55 and the first supply coupling portion 54, and through the supply-side coupling flow path 50. Since the controller 90 repeatedly performs the opening/closing operation of the supply-side opening/closing valve 64, it is possible to further reduce the air bubbles remaining in the supply-side coupling flow path 50.

(3) The supply-side coupling flow path 50 includes the supply-side air bubble trap chamber 61*a*, and the third supply coupling portion 56 to which the supply-side branch flow path 51 is coupled is provided in the supply-side air bubble trap chamber 61*a*. When the supply pump 70 is driven in a state where the supply-side opening/closing valve 64 is closed, the air bubbles circulating through the liquid supply flow path 39 between the second supply coupling portion 55 and the first supply coupling portion 54 and through the supply-side coupling flow path 50 are collected in the supply-side air bubble trap chamber 61*a*. Therefore, since the air bubbles collected in the supply-side air bubble trap chamber 61*a* can be collected in the liquid storage unit 39*b* through the supply-side branch flow path 51, the air bubbles remaining in the supply-side coupling flow path 50 can be efficiently discharged.

(4) The supply-side air bubble trap chamber 61*a* includes the supply-side inclined portion 62*a* that is inclined upward toward the third supply coupling portion 56. The air bubbles trapped in the supply-side air bubble trap chamber 61*a* are guided by the supply-side inclined portion 62*a* and are collected at the third supply coupling portion 56, so that the air bubbles can be efficiently discharged.

(5) The first supply differential pressure valve 66 is provided in the supply-side coupling flow path 50 between the third supply coupling portion 56 and the second supply coupling portion 55, and the second supply differential pressure valve 69 is provided in the liquid supply flow path 39 between the liquid storage unit 39*b* and the second supply coupling portion 55. For this reason, when the second vacuum pump 24*b* decompresses the inside of the liquid storage unit 39*b*, the liquid in the liquid ejection head 18 is collected in the liquid storage unit 39*b* via the liquid supply flow path 39, the first supply coupling portion 54, the supply-side coupling flow path 50, the third supply coupling portion 56, and the supply-side branch flow path 51. Therefore, the liquid is collected from the liquid ejection head 18 to the liquid storage unit 39*b*, for example, when removing the liquid ejection head 18 from the loader 19, so that it is possible to reduce the risk of liquid leaking from the removed liquid ejection head 18.

(6) When the flow of the liquid stagnates, the components in the liquid may settle and the concentration may be uneven. In this respect, the liquid supplied from the liquid storage unit 39*b* to the liquid ejection head 18 via the downstream supply flow path 39*c* is collected in the liquid storage unit 39*b* via the liquid collection flow path 40. The supply pump 70 and the collection pump 75 circulate the liquid through the liquid storage unit 39*b*, the downstream supply flow path 39*c*, the liquid ejection head 18, and the liquid collection flow path 40, so that it is possible to reduce the concentration bias of the liquid.

(7) The first mounting unit 26 to which the liquid container 28 is mounted is provided, and the liquid is supplied from the liquid container 28 mounted to the first mounting unit 26 to the liquid storage unit 39*b*. Therefore, the liquid can be easily supplied to the liquid storage unit 39*b*.

(8) The water vapor supply unit 21 supplies the water vapor into the circulation flow path 41. Therefore, the water obtained by taking in the supplied water vapor is added to the liquid in the circulation flow path 41. Therefore, the thickening of the liquid in the circulation flow path 41 can be suppressed.

(9) The water vapor is taken into the liquid from the liquid surface of the liquid. Therefore, the larger the surface area of the liquid surface that comes into contact with water vapor, the easier it is for the liquid to take in the water vapor. In this respect, the water vapor supply unit 21 supplies the water vapor to the first water vapor replenishment chamber 22*a* to the third water vapor replenishment chamber 22*c* provided in the circulation flow path 41. Therefore, it is possible to increase the areas of the first liquid surface 34*a* to the third liquid surface 34*c* that come into contact with water vapor by providing the first water vapor replenishment chamber 22*a* to the third water vapor replenishment chamber 22*c*, so that the water vapor can be efficiently taken into the liquid.

(10) The water vapor supply unit 21 supplies the water vapor to the second water vapor replenishment chamber 22*b* provided in the liquid supply flow path 39. Therefore, it is possible to easily add the water to the liquid supplied to the liquid ejection head 18.

(11) The liquid supply flow path 39 includes the liquid storage unit 39*b*. For this reason, for example, even when the liquid is not supplied from the liquid container 28 due to the replacement of the liquid container 28, the liquid stored in the liquid storage unit 39*b* can be supplied to the liquid ejection head 18. Since the second water vapor replenishment chamber 22*b* is provided in the liquid storage unit 39*b*, it is possible to efficiently take in the water into the liquid using the second liquid surface 34*b* of the liquid stored in the liquid storage unit 39*b*.

(12) The water vapor supply unit 21 supplies the water vapor that has passed through the semipermeable membrane 87 to the first water vapor replenishment chamber 22*a* to the third water vapor replenishment chamber 22*c*. Since the semipermeable membrane 87 does not pass the liquid, it is possible to reduce the risk that the moisturizing liquid for generating the water vapor is directly supplied to the first water vapor replenishment chamber 22*a* to the third water vapor replenishment chamber 22*c*.

(13) In the liquid ejection head 18 having the nozzles 33 that eject the liquid, the liquid in the nozzles 33 comes into contact with the air, so that the water is likely to evaporate. In this respect, the water vapor supply unit 21 supplies the water vapor to the third water vapor replenishment chamber 22*c* provided in the liquid collection flow path 40. Therefore, the water vapor supply unit 21 can efficiently add the water to the liquid whose viscosity has increased in the liquid ejection head 18.

(14) The liquid collection flow path 40 includes the collection storage unit 40*b*. Therefore, even when the liquid is not supplied from the liquid container 28, the liquid stored in the collection storage unit 40*b* can be supplied to the liquid ejection head 18. Since the third water vapor replenishment chamber 22*c* is provided in the collection storage unit 40*b*, it is possible to efficiently take in the water into the liquid using the third liquid surface 34*c* of the liquid stored in the collection storage unit 40*b*.

(15) In the liquid ejection head 18 having the nozzles 33 that ejects liquid, the liquid in the nozzles 33 comes into contact with air, so that the water is likely to evaporate. In this respect, the water vapor supply unit 21 supplies the water vapor to the first water vapor replenishment chamber 22*a* provided in the liquid ejection head 18. Therefore, the water vapor supply unit 21 can efficiently add the water to the liquid, in the liquid ejection head 18, whose viscosity is likely to increase.

(16) The plurality of circulation flow paths 41 makes it possible to supply, for example, a plurality of liquids of different types to the liquid ejection head 18. Since the water vapor supply unit 21 supplies the water vapor to the plurality of circulation flow paths 41 in a collective manner, the number of members can be reduced, compared with the case where the water vapor supply units 21 individually corresponding to the plurality of circulation flow paths 41 are provided.

(17) When the amount of the water vapor supplied is large, the liquid may have a too low viscosity. In this respect, the controller 90 controls the amount of the water vapor to be supplied according to the viscosity of the liquid. Therefore, it is possible to add to the liquid an appropriate amount of the water vapor.

(18) When the amount of the water vapor supplied is large, the liquid may have a too low concentration. In this respect, the controller 90 controls the amount of the water vapor to be supplied according to the concentration of the liquid. Therefore, it is possible to add to the liquid an appropriate amount of the water vapor.

This embodiment can be modified and implemented as follows. The present embodiment and the following modifications can be implemented in combination with one another as long as there is no technical contradiction.

Figure 18:
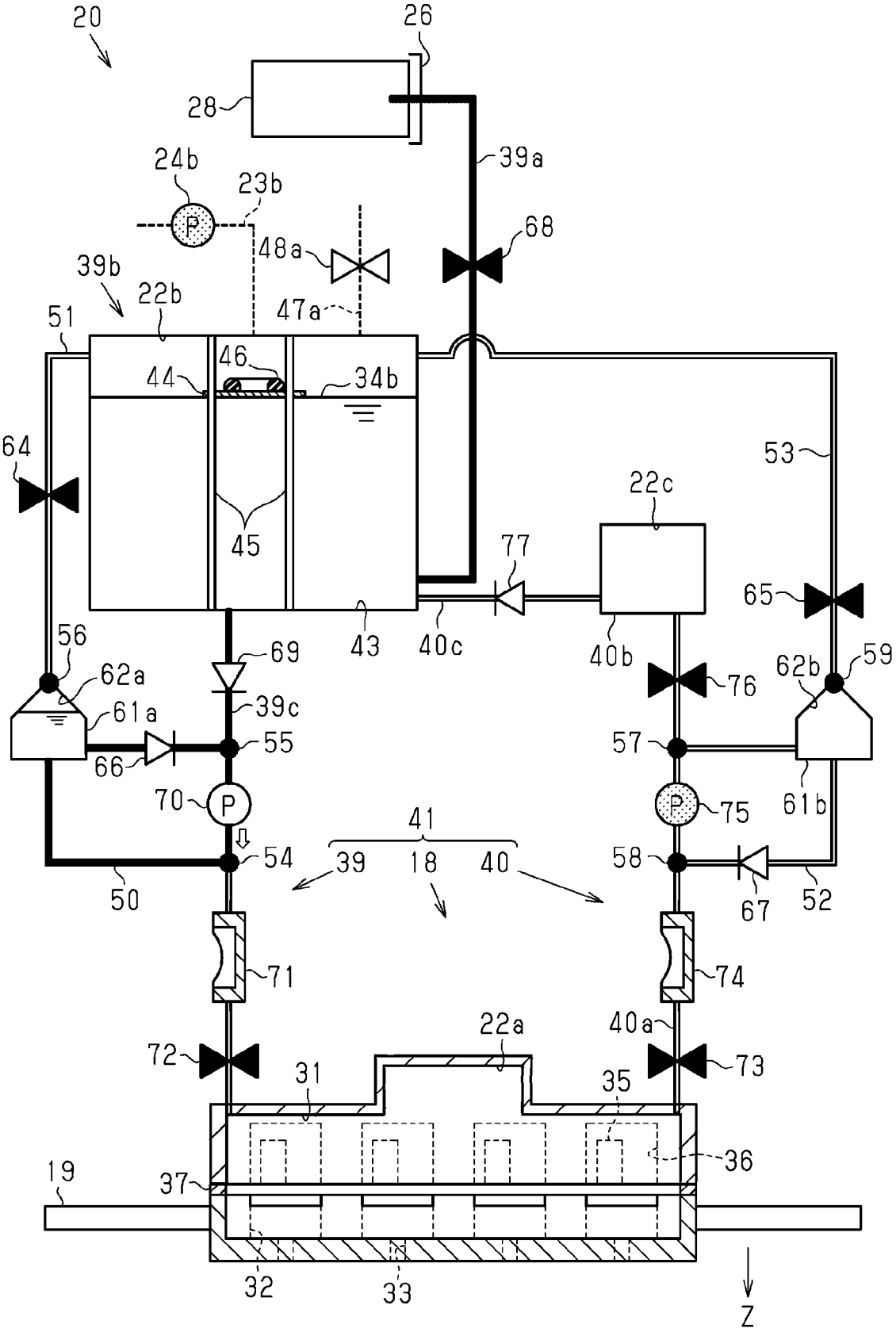
FIG. 18 is a schematic diagram of a modification in which the supply pump is driven before opening the supply-side opening/closing valve.

When the empty liquid supply unit 20 is filled with the liquid, the controller 90 may drive the supply pump 70 in a state where the supply-side opening/closing valve 64 is closed as shown in FIG. 18 after supplying the liquid from the liquid container 28 to the liquid storage unit 39*b* as shown in FIG. 9. The controller 90 may open the supply-side opening/closing valve 64 as shown in FIG. 12 after the air bubble collection time has elapsed since the supply pump 70 was driven. As shown in FIG. 18, when the supply pump 70 is driven in a state where the supply-side opening/closing valve 64 is closed, the liquid supply flow path 39 between the second supply coupling portion 55 and the first supply coupling portion 54, and the supply-side coupling flow path 50 are filled with the liquid, and the air bubbles are collected in the supply-side air bubble trap chamber 61*a*. The air bubble collection time is a time required to collect the air bubbles in the supply-side air bubble trap chamber 61*a*. Thereafter, as shown in FIG. 12, the controller 90 opens the supply-side opening/closing valve 64. The air bubbles collected in the supply-side air bubble trap chamber 61*a* are sent to the liquid storage unit 39*b* through the supply-side branch flow path 51. The controller 90 may repeatedly open/close the supply-side opening/closing valve 64.

Figure 19:
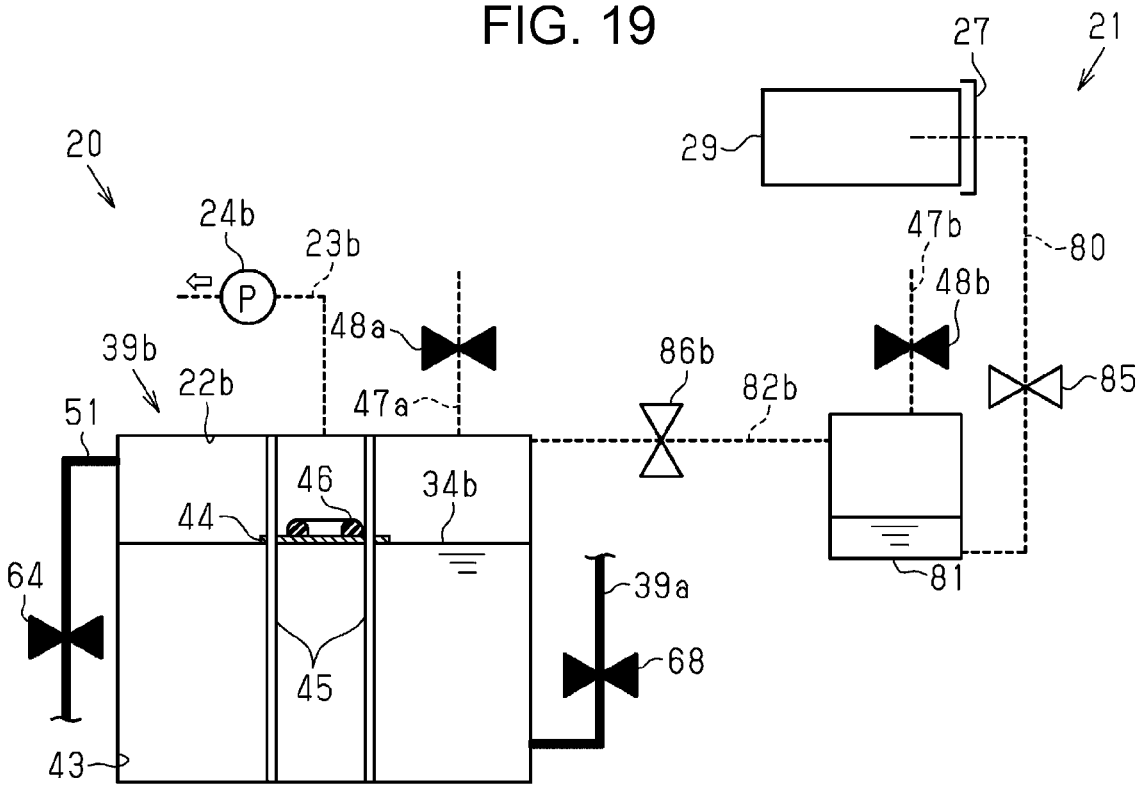
FIG. 19 is a schematic diagram showing a state in which the moisturizing liquid is supplied to the water vapor supply unit in a first modification.
Figure 20:
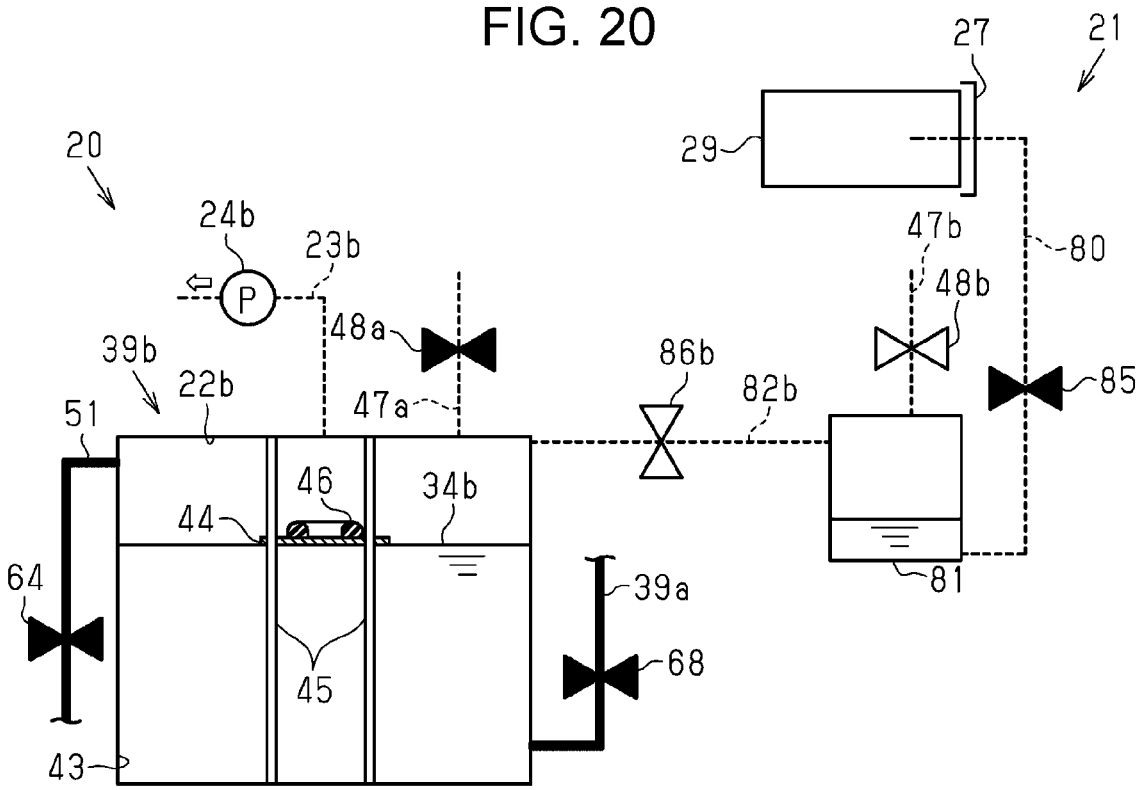
FIG. 20 is a schematic diagram showing a state in which the water vapor supply unit supplies a water vapor in the first modification.
Figure 21:
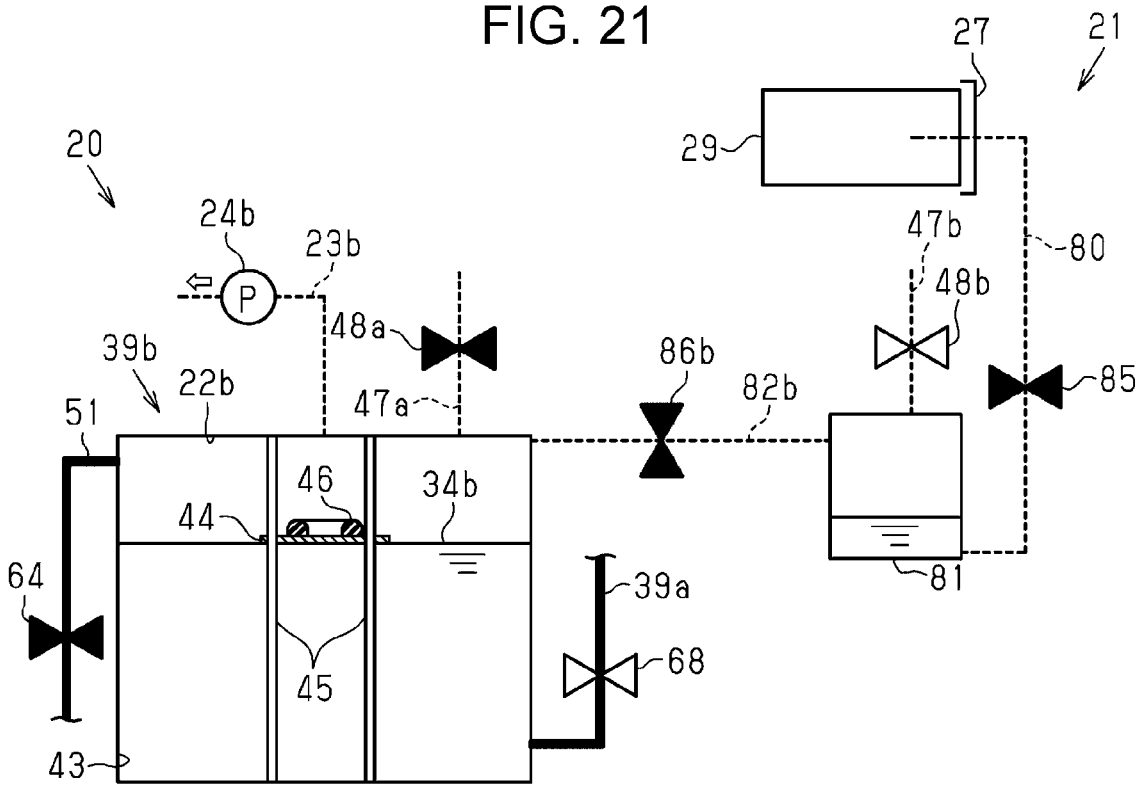
FIG. 21 is a schematic diagram showing a state in which the liquid is supplied to the liquid storage unit in the first modification.

As in the first modification shown in FIGS. 19 to 21, the liquid ejecting apparatus 11 may not include the fourth vacuum pump 84. As shown in FIG. 19, when the moisturizing liquid is stored in the water vapor generator 81, the controller 90 closes the upstream supply valve 68, the supply-side opening/closing valve 64, the first atmosphere release valve 48*a*, and the second atmosphere release valve 48*b*, and opens the moisturizing liquid supply valve 85 and the second water vapor supply valve 86*b*. The controller 90 may drive the second vacuum pump 24*b* in this state to supply the moisturizing liquid from the moisturizing liquid container 29 to the water vapor generator 81. As shown in FIG. 20, when replenishing the second water vapor replenishment chamber 22*b* with the water vapor, the controller 90 closes the upstream supply valve 68, the supply-side opening/closing valve 64, the first atmosphere release valve 48*a*, and the moisturizing liquid supply valve 85, and opens the second atmosphere release valve 48*b* and the second water vapor supply valve 86*b*. The controller 90 may drive the second vacuum pump 24*b* in this state to supply the water vapor from the water vapor generator 81 to the second water vapor replenishment chamber 22*b*. The water vapor supply unit 21 may supply the water vapor to the first water vapor replenishment chamber 22*a* and the third water vapor replenishment chamber 22*c* as well. As shown in FIG. 21, when supplying the liquid to the liquid storage unit 39*b*, the controller 90 may open the upstream supply valve 68, close the second water vapor supply valve 86*b*, and drive the second vacuum pump 24*b*.

Figure 22:
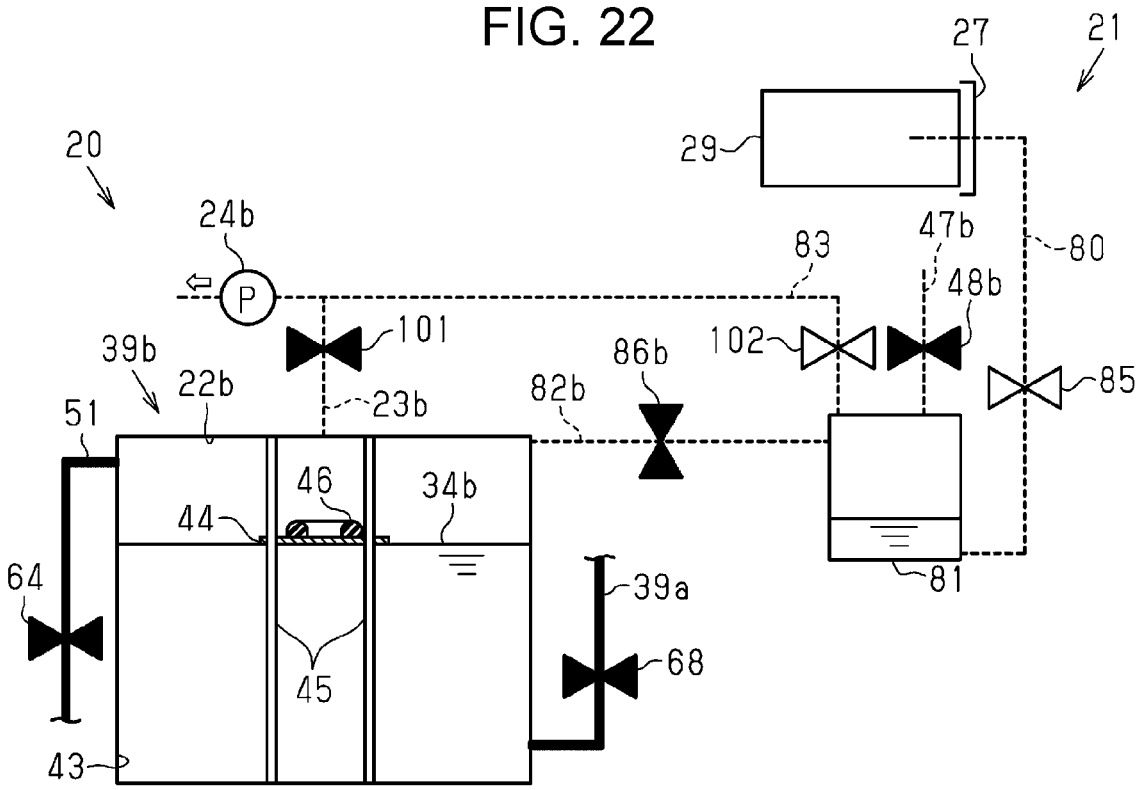
FIG. 22 is a schematic diagram showing a state in which the moisturizing liquid is supplied to the water vapor supply unit in a second modification.
Figure 23:
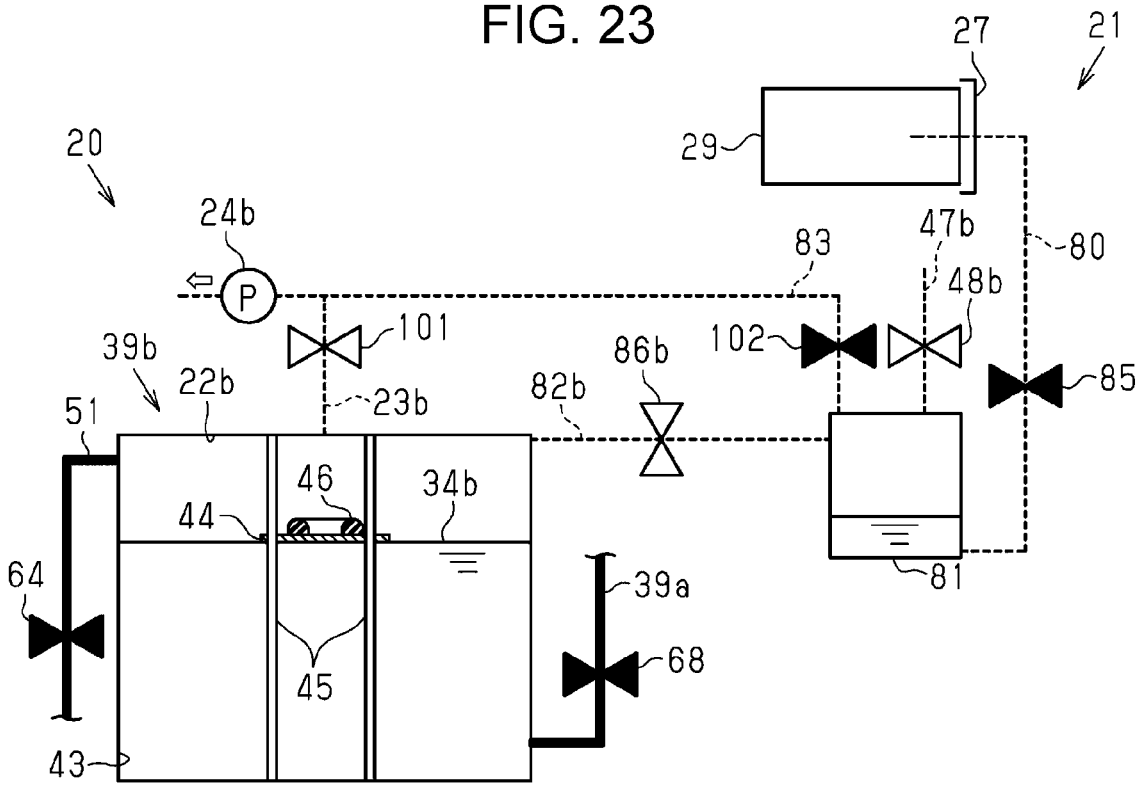
FIG. 23 is a schematic diagram showing a state in which the water vapor supply unit supplies a water vapor in the second modification.
Figure 24:
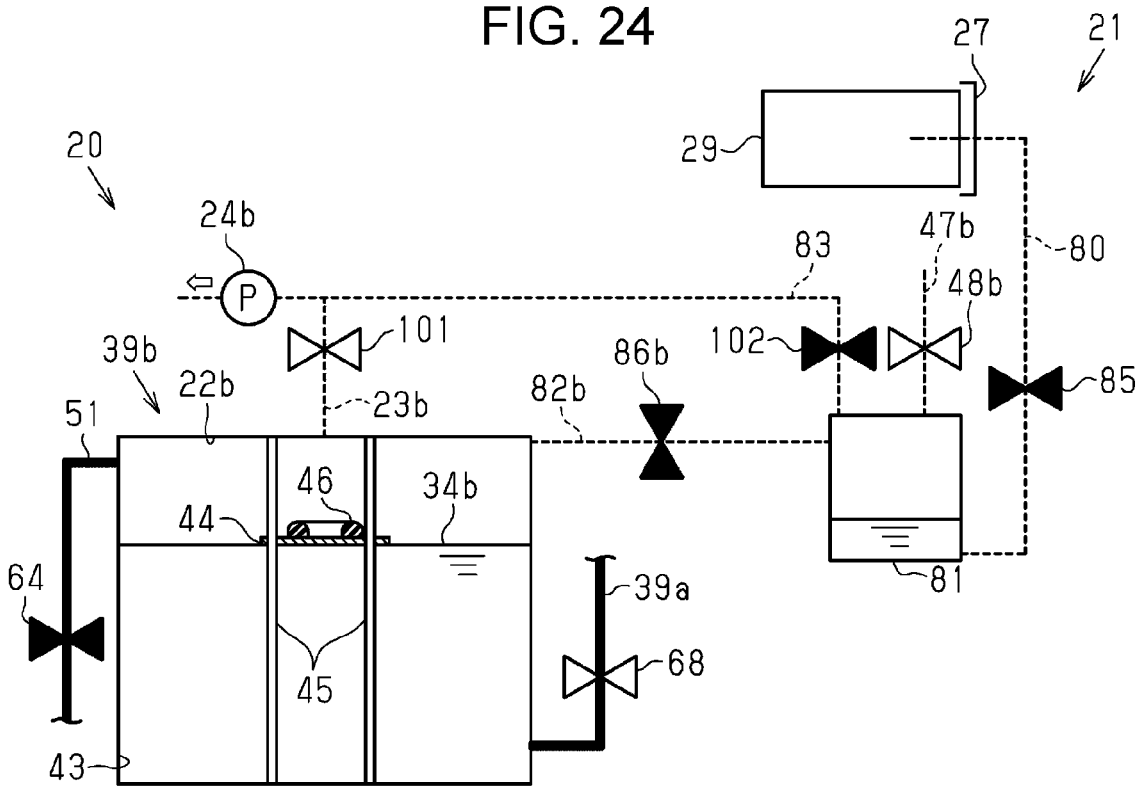
FIG. 24 is a schematic diagram showing a state in which the liquid is supplied to the liquid storage unit in the second modification.

As in the second modification shown in FIGS. 22 to 24, the liquid ejecting apparatus 11 may have a configuration in which the fourth vacuum flow path 83 are coupled to the second vacuum flow path 23*b*, and the second vacuum pump 24*b* decompress the second water vapor replenishment chamber 22*b* and the water vapor generator 81. The liquid ejecting apparatus 11 may include a first vacuum valve 101 provided in the second vacuum flow path 23*b* and a second vacuum valve 102 provided in the fourth vacuum flow path 83. As shown in FIG. 22, when the moisturizing liquid is stored in the water vapor generator 81, the controller 90 closes the upstream supply valve 68, the supply-side opening/closing valve 64, the second atmosphere release valve 48*b*, the second water vapor supply valve 86*b*, and the first vacuum valve 101, and opens the moisturizing liquid supply valve 85 and the second vacuum valve 102. The controller 90 may drive the second vacuum pump 24*b* in this state to supply the moisturizing liquid from the moisturizing liquid container 29 to the water vapor generator 81. As shown in FIG. 23, when replenishing the second water vapor replenishment chamber 22*b* with the water vapor, the controller 90 closes the upstream supply valve 68, the supply-side opening/closing valve 64, the moisturizing liquid supply valve 85, and the second vacuum valve 102, and opens the second atmosphere release valve 48*b*, the second water vapor supply valve 86*b*, and the first vacuum valve 101. The controller 90 may drive the second vacuum pump 24*b* in this state to supply the water vapor from the water vapor generator 81 to the second water vapor replenishment chamber 22*b*. The water vapor supply unit 21 may supply the water vapor to the first water vapor replenishment chamber 22*a* and the third water vapor replenishment chamber 22*c* as well. As shown in FIG. 24, when supplying the liquid to the liquid storage unit 39*b*, the controller 90 may open the upstream supply valve 68, close the second water vapor supply valve 86*b*, and drive the second vacuum pump 24*b*.

Figure 25:
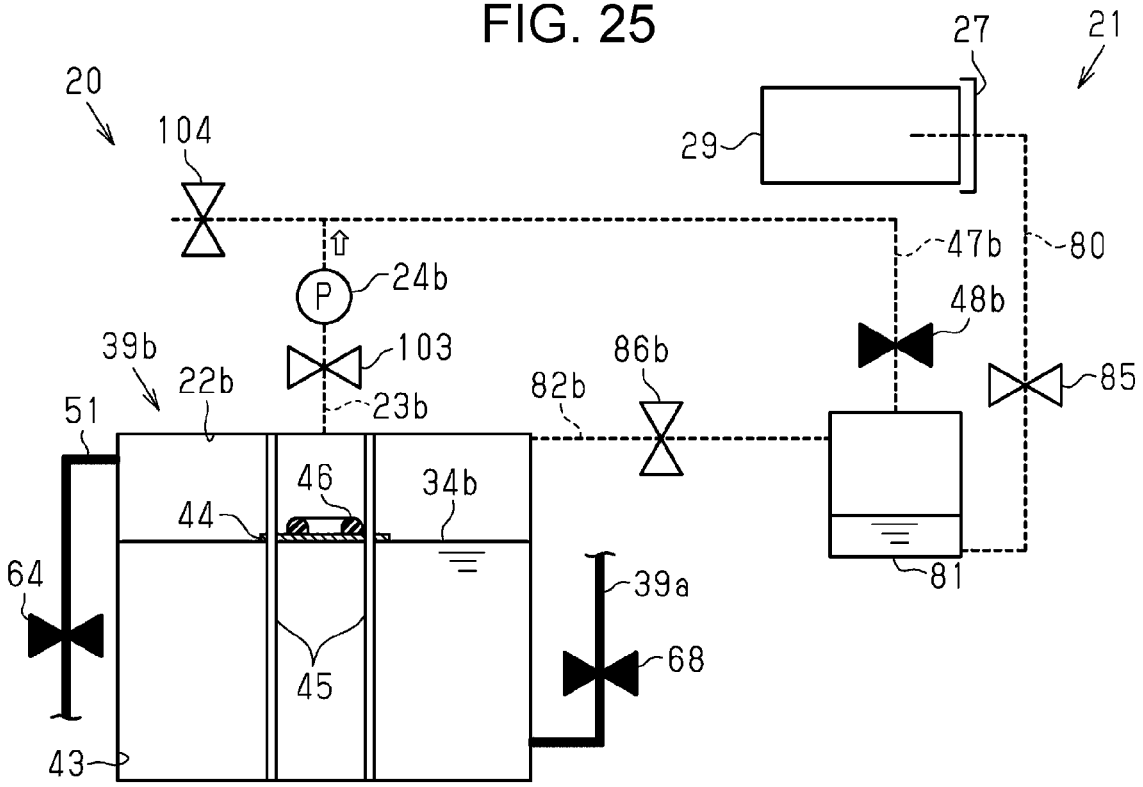
FIG. 25 is a schematic diagram showing a state in which the moisturizing liquid is supplied to the water vapor supply unit in a third modification.
Figure 26:
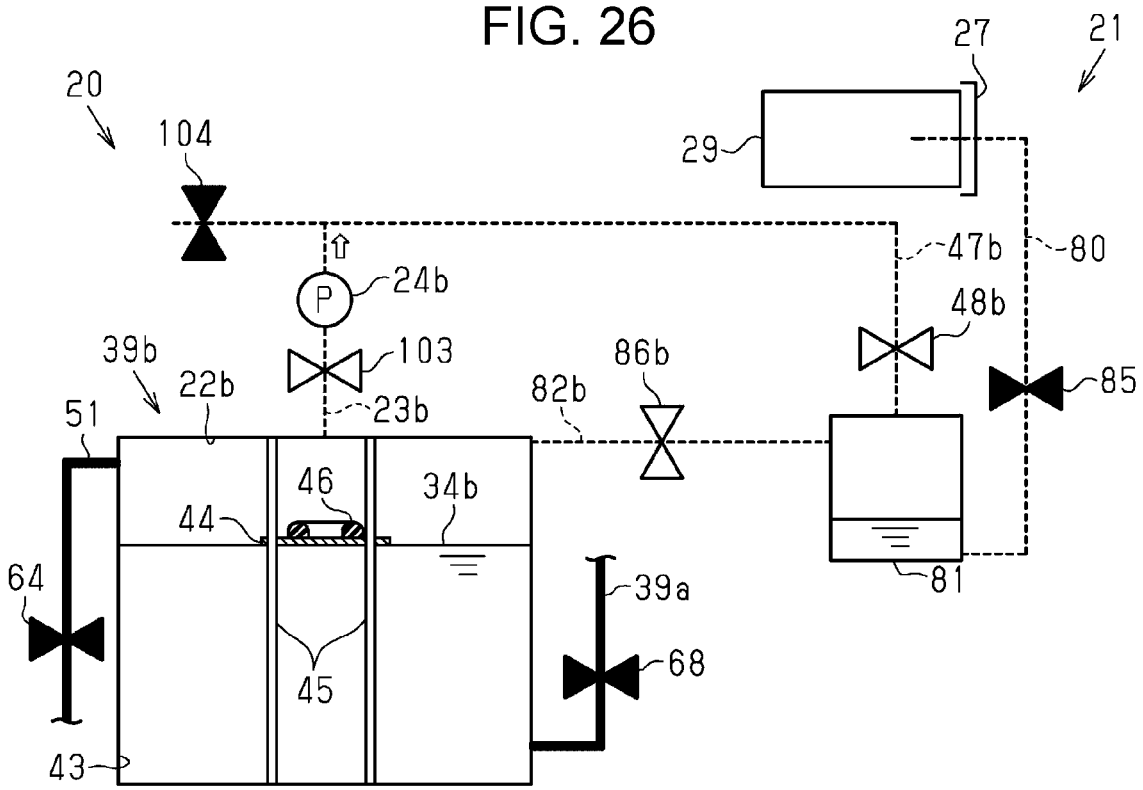
FIG. 26 is a schematic diagram showing a state in which the water vapor supply unit supplies a water vapor in the third modification.
Figure 27:
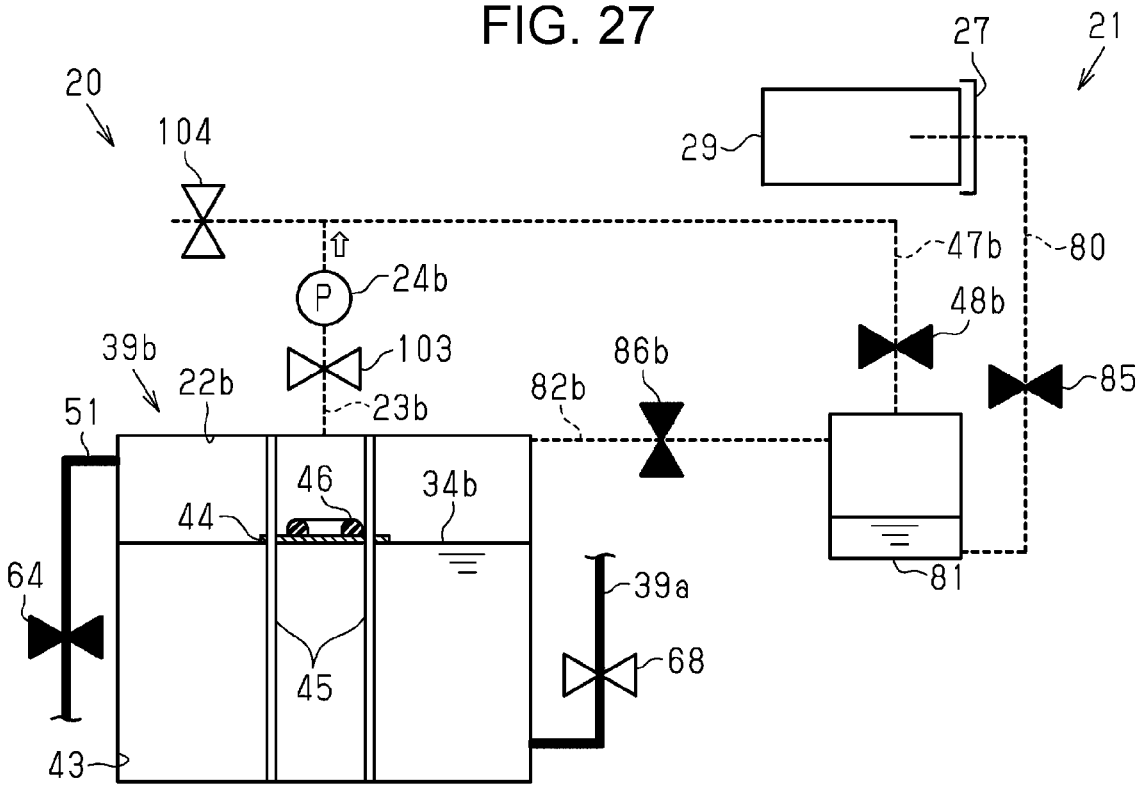
FIG. 27 is a schematic diagram showing a state in which the liquid is supplied to the liquid storage unit in the third modification.

As in the third modification shown in FIGS. 25 to 27, the liquid ejecting apparatus 11 may include a third vacuum valve 103 and a fourth vacuum valve 104 provided in the second vacuum flow path 23*b*. The third vacuum valve 103 is provided upstream of the second vacuum pump 24*b* and between the second vacuum pump 24*b* and the second water vapor replenishment chamber 22*b*. The fourth vacuum valve 104 is provided downstream of the second vacuum pump 24*b*. The second communication flow path 47*b* is coupled to the second vacuum flow path 23*b* between the second vacuum pump 24*b* and the fourth vacuum valve 104. As shown in FIG. 25, when the moisturizing liquid is stored in the water vapor generator 81, the controller 90 closes the upstream supply valve 68, the supply-side opening/closing valve 64, and the second atmosphere release valve 48*b*, and opens the moisturizing liquid supply valve 85, the second water vapor supply valve 86*b*, the third vacuum valve 103, and the fourth vacuum valve 104. The controller 90 may drive the second vacuum pump 24*b* in this state to supply the moisturizing liquid from the moisturizing liquid container 29 to the water vapor generator 81. As shown in FIG. 26, when replenishing the second water vapor replenishment chamber 22*b* with the water vapor, the controller 90 closes the upstream supply valve 68, the supply-side opening/closing valve 64, the moisturizing liquid supply valve 85, and the fourth vacuum valve 104, and opens the second atmosphere release valve 48*b*, the second water vapor supply valve 86*b*, and the third vacuum valve 103. The controller 90 may drive the second vacuum pump 24*b* in this state to supply the water vapor to the water vapor generator 81 and the second water vapor replenishment chamber 22*b*. Specifically, air containing the water vapor may be circulated through the water vapor generator 81, the second water vapor flow path 82*b*, the second water vapor replenishment chamber 22*b*, the second vacuum flow path 23*b*, and the second communication flow path 47*b*. The water vapor supply unit 21 may supply the water vapor to the first water vapor replenishment chamber 22*a* and the third water vapor replenishment chamber 22*c* as well. As shown in FIG. 27, when supplying the liquid to the liquid storage unit 39*b*, the controller 90 closes the second atmosphere release valve 48*b*, the supply-side opening/closing valve 64, the moisturizing liquid supply valve 85, and the second water vapor supply valve 86*b*, and opens the upstream supply valve 68, the third vacuum valve 103, and the fourth vacuum valve 104. The controller 90 may drive the second vacuum pump 24*b* in this state to supply the liquid from the liquid container 28 to the liquid storage unit 39*b*.

Figure 28:
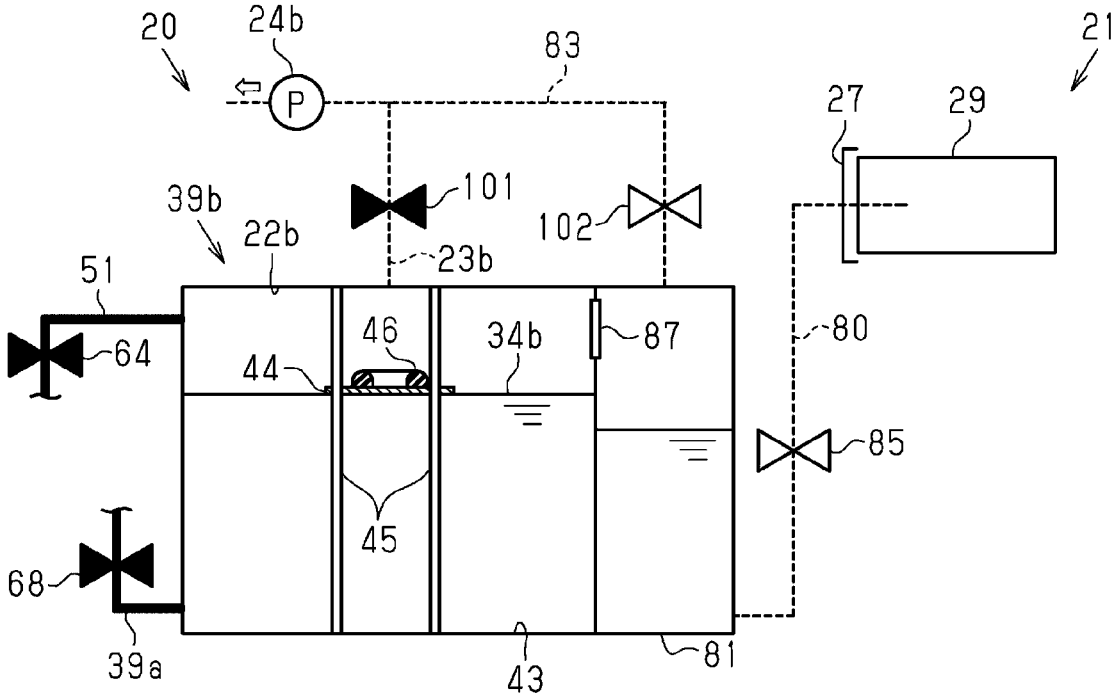
FIG. 28 is a schematic diagram showing a state in which the moisturizing liquid is supplied to the water vapor supply unit in a fourth modification.
Figure 29:
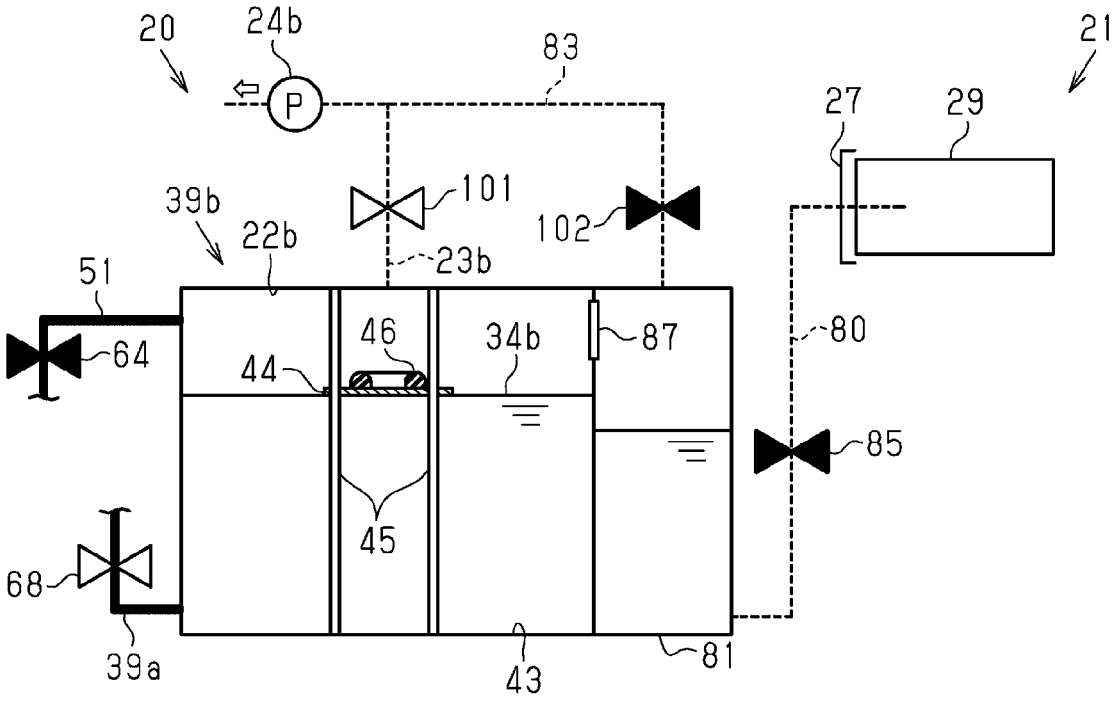
FIG. 29 is a schematic diagram showing a state in which the liquid is supplied to the liquid storage unit in the fourth modification.

As in the fourth modification shown in FIGS. 28 and 29, the liquid ejecting apparatus 11 may have a configuration in which the liquid storage unit 39*b* and the water vapor generator 81 are integrated. The second water vapor replenishment chamber 22*b* and the water vapor generator 81 may communicate with each other via the semipermeable membrane 87. In this case, the liquid ejecting apparatus 11 may not include the second water vapor flow path 82*b* or the second water vapor supply valve 86*b*. As shown in FIG. 28, when the moisturizing liquid is stored in the water vapor generator 81, the controller 90 closes the first vacuum valve 101 and opens the moisturizing liquid supply valve 85 and the second vacuum valve 102. The controller 90 may drive the second vacuum pump 24*b* in this state to supply the moisturizing liquid from the moisturizing liquid container 29 to the water vapor generator 81. The water vapor generated in the water vapor generator 81 passes through the semipermeable membrane 87 to move to the second water vapor replenishment chamber 22*b*. The water vapor supply unit 21 may supply the water vapor to the first water vapor replenishment chamber 22*a* and the third water vapor replenishment chamber 22*c* as well. As shown in FIG. 29, when supplying the liquid to the liquid storage unit 39*b*, the controller 90 closes the supply-side opening/closing valve 64, the moisturizing liquid supply valve 85, and the second vacuum valve 102, and opens the upstream supply valve 68 and the first vacuum valve 101. The controller 90 may drive the second vacuum pump 24*b* in this state to supply the liquid from the liquid container 28 to the liquid storage unit 39*b*.

The upstream end of the liquid collection flow path 40 may be coupled to the pressure chamber 32. The pressure chamber 32 may form part of the circulation flow path 41. The upstream end of the liquid collection flow path 40 may be coupled to the liquid supply flow path 39.

The downstream end of the liquid collection flow path 40 may be coupled to the upstream supply flow path 39*a* or the downstream supply flow path 39*c*. The circulation flow path 41 may be configured by the liquid supply unit 20 and the liquid collection flow path 40.

The controller 90 may supply the water vapor into the circulation flow path 41 when the concentration sensed by the concentration sensing unit 93 is higher than the threshold. In this case, the controller 90 may supply the water vapor to at least one of the first water vapor replenishment chamber 22*a* to the third water vapor replenishment chamber 22*c*. The controller 90 may not supply the water vapor when the concentration is lower than the threshold.

The controller 90 may supply the water vapor into the circulation flow path 41 when the liquid viscosity estimated by detecting the vibration waveform of the pressure chamber 32 is higher than the threshold. In this case, the controller 90 may supply the water vapor to at least one of the first water vapor replenishment chamber 22*a* to the third water vapor replenishment chamber 22*c*. The controller 90 may not supply the water vapor when the viscosity is lower than the threshold.

The controller 90 may supply the water vapor into the circulation flow path 41 based on any one of the concentration of the liquid and the viscosity of the liquid. The controller 90 may supply the water vapor regardless of the concentration and the viscosity of the liquid. For example, the controller 90 may supply the water vapor to the circulation flow path 41 regularly, or may constantly supply the water vapor. The controller 90 may supply the water vapor when the liquid ejecting apparatus 11 is powered on. The controller 90 may supply the water vapor when the liquid ejecting apparatus 11 is powered off. The controller 90 may store the usage pattern of the liquid ejecting apparatus 11, and, for example, may not supply the water vapor during the day when the usage frequency is high, and may supply the water vapor at night when the usage frequency is low. When the water vapor is supplied at night, the water vapor can be supplied at low cost by using midnight power. When the water vapor is supplied during the time of low usage frequency, it is possible to perform printing in an optimal state when the liquid ejecting apparatus 11 is used.

The controller 90 may circulate the liquid and supply the water vapor when a command to print the medium is input.

The higher the temperature, the easier the liquid is to evaporate. The liquid ejecting apparatus 11 may include a thermometer that measures the ambient temperature. The controller 90 may increase the amount of the water vapor to be supplied into the circulation flow path 41 when the temperature is high, compared with when the temperature is low.

The lower the humidity, the easier the liquid is to evaporate. The liquid ejecting apparatus 11 may include a hygrometer that measures the ambient humidity. The controller 90 may increase the amount of the water vapor to be supplied into the circulation flow path 41 when the humidity is low, compared with when the humidity is high.

The longer the liquid stays in the circulation flow path 41, the more the evaporation proceeds. When the amount of the liquid stored in the liquid storage unit 39*b* is smaller than the supply threshold, the controller 90 may supply the liquid from the liquid container 28, and may cause the liquid storage unit 39*b* to store the liquid in an amount such that the valve 46 is located at the closed position. When the liquid is supplied in this way, the lower the position of the second liquid surface 34*b* is, for the longer time the liquid stored in the liquid storage unit 39*b* is stored in the liquid storage unit 39*b*. The liquid ejecting apparatus 11 may include a liquid surface detection unit that detects the position of the second liquid surface 34*b* of the liquid storage unit 39*b*. The controller 90 may increase the amount of the water vapor to be supplied into the circulation flow path 41 when the amount of the liquid stored in the liquid storage unit 39*b* is small, and the position of the second liquid surface 34*b* is low, compared with when the position of the second liquid surface 34*b* is high.

The controller 90 may increase the amount of the water vapor to be supplied into the circulation flow path 41 when driving the supply pump 70 and the collection pump 75 to cause the liquid to circulate through the circulation flow path 41, compared with when stopping driving the supply pump 70 and the collection pump 75 to cause the liquid not to circulating through the circulation flow path 41. The controller 90 may drive the supply pump 70 and the collection pump 75 to circulate the liquid while supplying the water vapor to the circulation flow path 41.

The controller 90 may supply the water vapor and circulate the liquid separately. In this case, the supply of the water vapor and the circulation of the liquid may be alternately repeated.

The liquid ejecting apparatus 11 may include a stirrer that can stir the liquid stored in the liquid storage unit 39*b*. The controller 90 may sequentially supply the water vapor to the liquid storage unit 39*b*, stir the liquid in the liquid storage unit 39*b*, and circulate the liquid, or may repeatedly perform these processes. It is possible to stabilize the concentration of the liquid in the liquid storage unit 39*b* by stirring the liquid in the liquid storage unit 39*b*. It is possible to supply the liquid having a stable concentration to the liquid ejection head 18 by circulating the liquid after stirring the liquid in the liquid storage unit 39*b*.

The liquid ejecting apparatus 11 may include a plurality of the water vapor supply units 21 and a plurality of the circulation flow paths 41. For example, the liquid ejecting apparatus 11 may include the three water vapor supply units 21 consisting of a water vapor supply unit that collectively supplies the water vapor to the plurality of first water vapor replenishment chambers 22*a*, a water vapor supply unit that collectively supplies the water vapor to the plurality of second water vapor replenishment chambers 22*b*, and a water vapor supply unit that collectively supplies the water vapor to the plurality of third water vapor replenishment chambers 22*c*. The water vapor supply unit 21 may be provided corresponding to each circulation flow path 41. That is, one water vapor supply unit 21 may supply the water vapor to at least one of the liquid ejection head 18, the liquid supply flow path 39, and the liquid collection flow path 40 that constitute one circulation flow path 41.

The liquid ejecting apparatus 11 may include one liquid supply unit 20. For example, the liquid ejecting apparatus 11 may be a monochrome printer that ejects black ink, which is an example of a liquid, to perform printing. The water vapor supply unit 21 may supply the water vapor to one circulation flow path 41 included in the liquid supply unit 20.

The liquid ejecting apparatus 11 may include at least one of the first water vapor replenishment chamber 22*a* to the third water vapor replenishment chamber 22*c*. The liquid ejecting apparatus 11 may not include the first water vapor replenishment chamber 22*a* to the third water vapor replenishment chamber 22*c*. For example, the liquid supply unit 20 may include the circulation flow path 41 part of which is configured by the semipermeable membrane 87, and the water vapor supply unit 21 may add the water vapor to the liquid via the semipermeable membrane 87.

The third water vapor replenishment chamber 22*c* may be provided in the liquid collection flow path 40 separately from the collection storage unit 40*b*. The liquid supply unit 20 may not include the collection storage unit 40*b*.

The semipermeable membrane 87 may be provided in the middle of or at the downstream end of the first water vapor flow path 82*a* to the third water vapor flow path 82*c*. The water vapor supply unit 21 may not include the semipermeable membrane 87. The water vapor supply unit 21 includes, for example, a blocking unit that blocks the moisturizing liquid flowing from the water vapor generator 81 to the first water vapor replenishment chamber 22*a* to the third water vapor replenishment chamber 22*c* when the liquid ejecting apparatus 11 is inclined.

The liquid supply unit 20 may not include at least one of the supply-side air bubble trap chamber 61*a* and the collection-side air bubble trap chamber 61*b*. For example, when the controller 90 drives the supply pump 70 in a state where the supply-side opening/closing valve 64 is opened, the liquid supply flow path 39 from the liquid storage unit 39*b* to the first supply coupling portion 54, the supply-side coupling flow path 50 from the first supply coupling portion 54 to the third supply coupling portion 56, and the supply-side branch flow path 51 is filled with the liquid. Afterwards, when the controller 90 drives the supply pump 70 in a state where the supply-side opening/closing valve 64 is closed, the air bubbles remaining in the supply-side coupling flow paths 50 from the third supply coupling portion 56 to the second supply coupling portion 55 together with the liquid circulate through the liquid supply flow path 39 from the supply-side coupling flow path 50 and the second supply coupling portion 55 to the first supply coupling portion 54. When the controller 90 drives the supply pump 70 again in a state where the supply-side opening/closing valve 64 is opened again, the air bubbles in the liquid supply flow path 39 from the second supply coupling portion 55 to the first supply coupling portion 54 and the supply-side coupling flow path 50 from the first supply coupling portion 54 to the third supply coupling portion 56 are sent to the liquid storage unit 39*b* via the supply-side branch flow path 51.

The liquid storage unit 39*b* may be a tank that has a refill hole through which the liquid can be added. The user may replenish the liquid storage unit 39*b* with the liquid through the refill hole. In this case, the liquid ejecting apparatus 11 may not include the first mounting unit 26, the upstream supply flow path 39*a*, or the upstream supply valve 68.

The water vapor generator 81 may be a tank having a refill hole through which the moisturizing liquid can be added. The user may replenish the water vapor generator 81 with the moisturizing liquid through the refill hole. In this case, the liquid ejecting apparatus 11 may not include the second mounting unit 27, the moisturizing liquid flow path 80, or the moisturizing liquid supply valve 85.

The liquid supply unit 20 may not include the liquid collection flow path 40, the collection-side coupling flow path 52, or the collection-side branch flow path 53, and may be configured not to circulate the liquid.

When filling the circulation flow path 41 with the liquid stored in the liquid storage unit 39*b*, the liquid supply unit 20 may not include the first supply differential pressure valve 66, the second supply differential pressure valve 69, the first collection differential pressure valve 67, or the second collection differential pressure valve 77. The liquid supply unit 20 may not include at least one of the first supply differential pressure valve 66, the second supply differential pressure valve 69, the first collection differential pressure valve 67, and the second collection differential pressure valve 77. The liquid supply unit 20 may be provided with a valve whose opening/closing control is performed by the controller 90 instead of these differential pressure valves.

The liquid supply unit 20 may supply the liquid stored in the liquid container 28 to the liquid storage unit 39*b* by the water head of the liquid. In this case, the liquid ejecting apparatus 11 may not include the second vacuum pump 24*b*.

The controller 90 may control, based on the detection result of the liquid surface detection unit that detects the position of the second liquid surface 34*b* of the liquid storage unit 39*b*, the liquid supply from the liquid container 28 to the liquid storage unit 39*b*.

The supply-side air bubble trap chamber 61*a* and the collection-side air bubble trap chamber 61*b* may have, at their tops, a conical shape, a sloping ceiling, or a flat ceiling. For example, the supply-side air bubble trap chamber 61*a* may have a conical shape at its upper portion and the supply-side inclined portion 62*a* may have a taper. The supply-side air bubble trap chamber 61*a* may have a pyramid shape at its upper portion, and the supply-side inclined portion 62*a* may be formed by one or a plurality of slopes.

The controller 90 may open the supply-side opening/closing valve 64 to drive the supply pump 70, close the supply-side opening/closing valve 64, and finish filling the supply-side coupling flow path 50 with the liquid. The liquid supply unit 20 may fill the downstream supply flow path 39*c* between the liquid storage unit 39*b* and the first supply coupling portion 54, and the supply-side coupling flow path 50 between the first supply coupling portion 54 to the third supply coupling portion 56, and may collect the air bubbles remaining in the supply-side coupling flow path 50 in the supply-side air bubble trap chamber 61*a*.

The liquid ejecting apparatus 11 may be a liquid ejecting apparatus that discharges or ejects a liquid other than ink. The state of the liquid ejected from the liquid ejecting apparatus in the form of a minute amount of droplets includes particles, teardrops, and filamentous tails. The liquid here may be any material that can be ejected from the liquid ejecting apparatus. For example, the liquid may be a substance in the state when the substance is in the liquid phase, and includes fluid materials such as liquids having high or low viscosity, sol, gel water, other inorganic solvents, organic solvents, solutions, liquid resins, liquid metals, metal melts. Further, the liquid includes not only a liquid as one state of a substance but also a liquid in which particles of a functional material made of a solid such as a pigment or metal particles are dissolved, dispersed or mixed in a solvent. Representative examples of the liquid include ink and liquid crystal as described in the above embodiment. Here, the ink includes various liquid compositions such as general water-based ink and oil-based ink, gel ink, and hot-melt ink. Specific examples of the liquid ejecting apparatus includes an apparatus that ejects a liquid containing a material such as an electrode material or a coloring material used for manufacturing a liquid crystal display, an electroluminescence display, a surface emitting display, a color filter or the like in a dispersed or dissolved form. The liquid ejecting apparatus may be an apparatus that ejects a bio-organic substance used in biochip manufacturing, an apparatus that ejects a liquid serving as a sample used as a precision pipette, printing equipment, a micro dispenser, or the like. The liquid ejecting apparatus may be an apparatus that ejects lubricating oil to a precision machine such as a watch or a camera at a pinpoint or an apparatus that ejects a transparent resin liquid such as an ultraviolet curable resin onto the substrate in order to form a micro hemispherical lens used for an optical communication element, an optical lens, or the like. The liquid ejecting apparatus may be an apparatus that ejects an etching liquid such as acid or alkali for etching the substrate and the like.

In the following, technical ideas and their functions and effects which are grasped from the above-described embodiments and modifications will be described.

(A) A liquid ejecting apparatus includes a liquid ejection head that ejects a liquid, a liquid supply flow path including a liquid storage unit that stores the liquid to be supplied to the liquid ejection head, where the liquid supply flow path supplies the liquid from the liquid storage unit to the liquid ejection head, a supply pump disposed in the liquid supply flow path, where the supply pump sends the liquid from the liquid storage unit to the liquid ejection head, a coupling flow path coupling a first coupling portion, in the liquid supply flow path, provided downstream of the supply pump and a second coupling portion, in the liquid supply flow path, provided upstream of the supply pump, a branch flow path coupling a third coupling portion provided in the coupling flow path and the liquid storage unit, an opening/closing valve provided in the branch flow path, where the opening/closing valve is configured to open/close the branch flow path, and a controller that controls an operation of the supply pump and the opening/closing valve, wherein the controller fills the coupling flow path and the branch flow path with the liquid with a combination of a drive of the supply pump and an opening/closing operation of the opening/closing valve.

According to this configuration, the coupling flow path couples the first coupling portion and the second coupling portion in the liquid supply flow path. The branch flow path couples the coupling flow path and the liquid storage unit. For this reason, when the supply pump is driven in a state where the opening/closing valve is open, the liquid sent from the liquid storage unit to the liquid supply flow path flows into the coupling flow path from the first coupling portion, and returns to the liquid storage unit via the branch flow path. That is, the branch flow path is filled with the liquid and part of the coupling flow path is also filled with the liquid. Therefore, it is possible to easily fill the coupling flow path with the liquid as compared with the case where filling the branch flow path with the liquid and filling the coupling flow path with the liquid are performed individually.

(B) In the liquid ejecting apparatus, the controller may repeatedly execute a driving the supply pump and the opening/closing operation of the opening/closing valve. When the supply pump is driven in a state where the opening/closing valve is open, the air bubbles located between the third coupling portion and the second coupling portion in the coupling flow path remain, while the air bubbles located between the first coupling portion and the third coupling portion in the coupling flow path are discharged. When the supply pump is driven in a state where the opening/closing valve is closed, the air bubbles remaining in the coupling flow path circulate through the liquid supply flow path between the second coupling portion and the first coupling portion and through the coupling flow path. According to this configuration, the controller repeatedly performs the opening/closing operation of the opening/closing valve, so that it is possible to further reduce air bubbles remaining in the coupling flow path.

(C) In the liquid ejecting apparatus, the coupling flow path may include an air bubble trap chamber, and the third coupling portion is provided at an upper portion of the air bubble trap chamber. According to this configuration, the coupling flow path includes the air bubble trap chamber, and the third coupling portion to which the branch flow path is coupled is provided in the air bubble trap chamber. When the supply pump is driven in a state where the opening/closing valve is closed, the air bubbles circulating through the liquid supply flow path between the second coupling portion and the first coupling portion and through the coupling flow path are collected in the air bubble trap chamber. Therefore, since the air bubbles collected in the air bubble trap chamber can be collected in the liquid storage unit through the branch flow path, the air bubbles remaining in the coupling flow path can be efficiently discharged.

(D) In the liquid ejecting apparatus, the air bubble trap chamber may include an inclined portion that is inclined upward toward the third coupling portion. According to this configuration, the air bubble trap chamber has the inclined portion that is inclined upward toward the third coupling portion. The air bubbles trapped in the air bubble trap chamber are guided by the inclined portion and are collected at the third coupling portion, so that the air bubbles can be efficiently discharged.

(E) The liquid ejecting apparatus may further include a vacuum pump that decompresses an inside of the liquid storage unit, a first differential pressure valve provided in the coupling flow path, a second differential pressure valve provided in the liquid supply flow path, and a loader to which the liquid ejection head is detachably loaded, wherein the first differential pressure valve may be provided between the third coupling portion and the second coupling portion to permit a flow of the liquid flowing from the third coupling portion to the second coupling portion, and restrict a flow of the liquid flowing from the second coupling portion to the third coupling portion, and wherein the second differential pressure valve may be provided between the liquid storage unit and the second coupling portion to permit a flow of the liquid flowing from the liquid storage unit to the second coupling portion, and restrict a flow of the liquid flowing from the second coupling portion to the liquid storage unit.

According to this configuration, the first differential pressure valve is provided in the coupling flow path between the third coupling portion and the second coupling portion, and the second differential pressure valve is provided in the liquid supply flow path between the liquid storage unit and the second coupling portion. For this reason, when the vacuum pump decompresses the inside of the liquid storage unit, the liquid in the liquid ejection head is collected in the liquid storage unit via the liquid supply flow path, the first coupling portion, the coupling flow path, the third coupling portion, and the branch flow path. Therefore, the liquid is collected from the liquid ejection head to the liquid storage unit, for example, when removing the liquid ejection head from the loader, so that it is possible to reduce the risk of liquid leaking from the removed liquid ejection head.

(F) The liquid ejecting apparatus may further include a liquid collection flow path for collecting the liquid from the liquid ejection head to the liquid storage unit, and a collection pump disposed in the liquid collection flow path, where the collection pump sends the liquid from the liquid ejection head to the liquid storage unit.

When the flow of the liquid stagnates, the components in the liquid may settle and the concentration may be uneven. In this respect, according to this configuration, the liquid supplied from the liquid storage unit to the liquid ejection head via the liquid supply flow path is collected in the liquid storage unit via the liquid collection flow path. The supply pump and the collection pump circulate the liquid through the liquid storage unit, the liquid supply flow path, the liquid ejection head, and the liquid collection flow path, so that it is possible to reduce the concentration bias of the liquid.

(G) The liquid ejecting apparatus may further include a mounting unit to which a liquid container that stores the liquid to be supplied to the liquid storage unit is mounted. According to this configuration, the mounting unit to which the liquid container is mounted is provided, and the liquid is supplied from the liquid container mounted to the mounting unit to the liquid storage unit. Therefore, the liquid can be easily supplied to the liquid storage unit.

(H) In a method of controlling a liquid ejecting apparatus, where the liquid ejecting apparatus includes a liquid ejection head that ejects a liquid, a liquid supply flow path including a liquid storage unit that stores the liquid to be supplied to the liquid ejection head, where the liquid supply flow path supplies the liquid from the liquid storage unit to the liquid ejection head, a supply pump disposed in the liquid supply flow path, where the supply pump sends the liquid from the liquid storage unit to the liquid ejection head, a coupling flow path coupling a first coupling portion, in the liquid supply flow path, provided downstream of the supply pump and a second coupling portion, in the liquid supply flow path, provided upstream of the supply pump, a branch flow path coupling a third coupling portion provided in the coupling flow path and the liquid storage unit, and an opening/closing valve provided in the branch flow path, the method includes driving the supply pump in a state where the opening/closing valve is open, closing the opening/closing valve after a first time elapses since the supply pump was driven, and opening the opening/closing valve after a second time elapses since the opening/closing valve was closed. According to this method, the same effect as that of the liquid ejecting apparatus can be obtained.

(I) In the method of controlling the liquid ejecting apparatus, the coupling flow path may include an air bubble trap chamber, wherein the third coupling portion may be provided at an upper portion of the air bubble trap chamber, wherein air bubbles may be trapped in the air bubble trap chamber during a period until the second time elapses since the opening/closing valve was closed, and wherein the air bubbles trapped in the air bubble trap chamber may be collected in the liquid storage unit through the branch flow path by opening the opening/closing valve after the second time elapses. According to this method, the same effect as that of the liquid ejecting apparatus can be obtained.

What is claimed is:

1. A liquid ejecting apparatus comprising: a liquid ejection head that ejects a liquid;

a liquid supply flow path including a liquid storage unit that stores the liquid to be supplied to the liquid ejection head, the liquid supply flow path supplying the liquid from the liquid storage unit to the liquid ejection head;

a supply pump disposed in the liquid supply flow path, the supply pump sending the liquid from the liquid storage unit to the liquid ejection head;

a coupling flow path coupling a first coupling portion, in the liquid supply flow path, provided downstream of the supply pump and a second coupling portion, in the liquid supply flow path, provided upstream of the supply pump;

a branch flow path coupling a third coupling portion provided in the coupling flow path and the liquid storage unit;

an opening/closing valve provided in the branch flow path, the opening/closing valve being configured to open/close the branch flow path; and a controller that controls an operation of the supply pump and the opening/closing valve, wherein the controller fills the coupling flow path and the branch flow path with the liquid with a combination of a drive of the supply pump and an opening/closing operation of the opening/closing valve.

2. The liquid ejecting apparatus according to claim 1, wherein the controller repeatedly executes a driving the supply pump and the opening/closing operation of the opening/closing valve.

3. The liquid ejecting apparatus according to claim 1, wherein the coupling flow path includes an air bubble trap chamber, and wherein the third coupling portion is provided at an upper portion of the air bubble trap chamber.

4. The liquid ejecting apparatus according to claim 3, wherein the air bubble trap chamber includes an inclined portion that is inclined upward toward the third coupling portion.

5. The liquid ejecting apparatus according to claim 3, further comprising:

a vacuum pump that decompresses an inside of the liquid storage unit;

a first differential pressure valve provided in the coupling flow path;

a second differential pressure valve provided in the liquid supply flow path; and a loader to which the liquid ejection head is detachably loaded, wherein the first differential pressure valve is provided between the third coupling portion and the second coupling portion to permit a flow of the liquid flowing from the third coupling portion to the second coupling portion, and restricts a flow of the liquid flowing from the second coupling portion to the third coupling portion, and wherein the second differential pressure valve is provided between the liquid storage unit and the second coupling portion to permit a flow of the liquid flowing from the liquid storage unit to the second coupling portion, and restricts a flow of the liquid flowing from the second coupling portion to the liquid storage unit.

6. The liquid ejecting apparatus according to claim 3, further comprising:

a liquid collection flow path for collecting the liquid from the liquid ejection head to the liquid storage unit; and a collection pump disposed in the liquid collection flow path, the collection pump sending the liquid from the liquid ejection head to the liquid storage unit.

7. The liquid ejecting apparatus according to claim 3, further comprising a mounting unit to which a liquid container that stores the liquid to be supplied to the liquid storage unit is mounted.

8. A method of controlling a liquid ejecting apparatus, the liquid ejecting apparatus including a liquid ejection head that ejects a liquid, a liquid supply flow path including a liquid storage unit that stores the liquid to be supplied to the liquid ejection head, the liquid supply flow path supplying the liquid from the liquid storage unit to the liquid ejection head, a supply pump disposed in the liquid supply flow path, the supply pump sending the liquid from the liquid storage unit to the liquid ejection head, a coupling flow path coupling a first coupling portion, in the liquid supply flow path, provided downstream of the supply pump and a second coupling portion, in the liquid supply flow path, provided upstream of the supply pump, a branch flow path coupling a third coupling portion provided in the coupling flow path and the liquid storage unit, and an opening/closing valve provided in the branch flow path, the method comprising:

driving the supply pump in a state where the opening/closing valve is open;

closing the opening/closing valve after a first time elapses since the supply pump was driven; and opening the opening/closing valve after a second time elapses since the opening/closing valve was closed.

9. The method of controlling the liquid ejecting apparatus according to claim 8, wherein the coupling flow path includes an air bubble trap chamber, wherein the third coupling portion is provided at an upper portion of the air bubble trap chamber, wherein air bubbles are trapped in the air bubble trap chamber during a period until the second time elapses since the opening/closing valve was closed, and wherein the air bubbles trapped in the air bubble trap chamber are collected in the liquid storage unit through the branch flow path by opening the opening/closing valve after the second time elapses.

* * * * *